US007480479B2

(12) United States Patent
Nanjo et al.

(10) Patent No.: US 7,480,479 B2
(45) Date of Patent: Jan. 20, 2009

(54) FIXING APPARATUS

(75) Inventors: Yuzuru Nanjo, Osaka (JP); Eiji Nakajima, Osaka (JP); Akihiro Kondo, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/798,258

(22) Filed: May 11, 2007

(65) Prior Publication Data

US 2007/0264061 A1 Nov. 15, 2007

Related U.S. Application Data

(63) Continuation of application No. 10/645,598, filed on Aug. 22, 2003, now Pat. No. 7,239,836.

(30) Foreign Application Priority Data

| | | |
|---|---|---|
| Aug. 23, 2002 | (JP) | 2002-244208 |
| Dec. 20, 2002 | (JP) | 2002-369242 |
| Dec. 20, 2002 | (JP) | 2002-369245 |
| Feb. 28, 2003 | (JP) | 2003-053342 |
| Feb. 28, 2003 | (JP) | 2003-053368 |

(51) Int. Cl.
*G03G 15/20* (2006.01)
*H05B 6/14* (2006.01)

(52) U.S. Cl. ..... 399/328; 399/329; 399/330; 399/331; 219/619

(58) Field of Classification Search ..... 399/69, 399/107, 122, 320, 328, 329, 330, 331, 333; 219/619, 635, 216
See application file for complete search history.

(56) References Cited

U.S. PATENT DOCUMENTS

| | | | | |
|---|---|---|---|---|
| 6,037,576 | A | 3/2000 | Okabayashi et al. | |
| 6,078,780 | A | 6/2000 | Abe et al. | |
| 6,359,269 | B1 | 3/2002 | Hayasaki et al. | |
| 6,455,824 | B2 * | 9/2002 | Takagi et al. | 219/619 |
| 6,605,802 | B2 | 8/2003 | Nagahira | |
| 6,639,195 | B2 | 10/2003 | Abe et al. | |
| 6,795,679 | B2 * | 9/2004 | Shimizu et al. | 399/333 |

(Continued)

FOREIGN PATENT DOCUMENTS

| | | |
|---|---|---|
| JP | 60-151676 | 8/1985 |

(Continued)

*Primary Examiner*—Hoan H Tran
(74) *Attorney, Agent, or Firm*—Smith, Gambrell & Russell, LLP

(57) ABSTRACT

A fixing apparatus used in an image forming apparatus has a fixing member for fixing toner on paper and a pressure member making contact therewith to form in between a nip through which paper is passed. The fixing member has a support member formed of a ferromagnetic material and a heating layer formed adjacent thereto in the form of a thin layer of a non-magnetic, electrically conductive material. When a high-frequency electric current is passed through an exciting coil that is combined with the fixing member, the fixing member produces a high-frequency magnetic field, thereby produces induced eddy currents in the heating layer of the fixing member, thereby produces Joule's heat in the heating layer, and thereby heats the fixing member. A leaking magnetic flux is absorbed by the support member of the ferromagnetic member, and thus has reduced influence on metal parts located around the fixing apparatus.

20 Claims, 21 Drawing Sheets

U.S. PATENT DOCUMENTS

| | | | | |
|---|---|---|---|---|
| 6,849,838 | B2 * | 2/2005 | Shimizu et al. | 219/635 |
| 6,925,271 | B2 * | 8/2005 | Suzuki et al. | 399/69 |
| 6,947,699 | B2 * | 9/2005 | Suzuki et al. | 399/329 |
| 7,205,515 | B2 * | 4/2007 | Kikuchi et al. | 219/619 |

FOREIGN PATENT DOCUMENTS

| | | |
|---|---|---|
| JP | 61-261763 | 11/1986 |
| JP | U-H03-62373 | 6/1991 |
| JP | 04-097187 | 3/1992 |
| JP | U-H04-93867 | 8/1992 |
| JP | 08-076620 | 3/1996 |
| JP | 09-050199 | 2/1997 |
| JP | 09-152807 | 6/1997 |
| JP | 09-197838 | 7/1997 |
| JP | 09-274403 | 10/1997 |
| JP | 10-074004 | 3/1998 |
| JP | 11-288190 | 10/1999 |
| JP | 2000-056603 | 2/2000 |
| JP | 2000-215973 | 8/2000 |
| JP | 2000-268952 | 9/2000 |
| JP | 2001-135471 | 5/2001 |
| JP | 2001-183933 | 7/2001 |
| JP | 2002-093566 | 3/2002 |
| JP | 2002-148982 | 5/2002 |

* cited by examiner

Fig. 14

| NON-MAGNETIC-METAL LAYER CONDITIONS | | | GENERATED HEAT AMOUNT (AS RATIO TO WHEN ONLY MAGNETIC METAL LAYER IS HEATED) | | |
|---|---|---|---|---|---|
| EDDY CURRENT LOAD R (Ω) | THICKNESS (μm) | | NON-MAGNETIC LAYER COPPER or SUS304 | MAGNETIC LAYER SUS430 | TOTAL HEAT AMOUNT |
| | COPPER | SUS304 | | | |
| — | 0.0 | 0.0 | 0.00 | 1.00 | 1.00 |
| $8.04 \times 10^{-3}$ | 2.1 | 90 | 0.35 | 0.70 | 1.05 |
| $5.76 \times 10^{-3}$ | 2.9 | 125 | 0.55 | 0.55 | 1.10 |
| $3.34 \times 10^{-3}$ | 5.0 | 215 | 0.80 | 0.30 | 1.10 |
| $2.88 \times 10^{-3}$ | 6.0 | 250 | 0.80 | 0.30 | 1.10 |
| $2.44 \times 10^{-3}$ | 7.0 | 300 | 0.80 | 0.20 | 1.00 |
| $1.67 \times 10^{-3}$ | 10 | 431 | 0.65 | 0.15 | 0.80 |
| $1.11 \times 10^{-3}$ | 15 | 647 | 0.50 | 0.10 | 0.60 |
| $8.35 \times 10^{-4}$ | 20 | 862 | 0.45 | 0.05 | 0.50 |
| $3.34 \times 10^{-4}$ | 50 | 2155 | 0.20 | 0.01 | 0.21 |

FIXING APPARATUS

CROSS REFERENCE TO RELATED APPLICATION

This application is a continuation of Ser. No. 10/645,598, filed Aug. 22, 2003 now U.S. Pat. No. 7,239,836 and which is being incorporated in its entirety herein by reference.

BACKGROUND OF THE INVENTION

1. Field of the Invention

The present invention relates to a fixing apparatus for applying heat to paper carrying toner so that the toner is fused so as to be fixed on the paper. In particular, the present invention relates to a fixing apparatus that employs induction heating.

2. Description of the Prior Art

Heat rollers are widely used in electrophotographic image forming apparatuses. In a fixing apparatus employing a heat roller, a heat source is incorporated in at least one of a pair of rollers that forms a nip, and the pair of rollers is heated by that heat source. Paper carrying a toner image is passed through the nip between the pair of rollers so heated, so that the toner is fused so as to be fixed on the paper.

Fixing using a heat roller as described above is typically achieved with a construction in which a heat source such as a halogen lamp is built into a roller so that the heat generated by the heat source is conducted to the surface of the roller. This generally results in inefficient heat conduction to the roller surface and thus in a great loss of heat. Moreover, heating the roller surface to a sufficiently high temperature requires a long time. That is, quite inconveniently, low heat conduction efficiency results in high electric power consumption and in a long warm-up time, specifically requiring as long as several minutes for the roller surface to reach a sufficiently high temperature to achieve fixing.

For the purposes of increasing heating efficiency and reducing the warm-up time, there have been proposed fixing apparatuses that employ induction heating. For example, Japanese Patent Application Laid-Open No. 2000-268952 discloses a fixing apparatus in which, as exciting coils, a first and a second coil are arranged opposite to each other so that they are magnetically coupled together cumulatively. A carrier member having a heating layer inside it passes between the first and second coils. The heating layer is made of copper, silver, aluminum, or a material having an electrical resistivity equal to or less than those of the just mentioned metals, and is formed into a thin layer. The magnetic flux excited by the exciting coils penetrates the heating layer while describing loops, and causes magnetic induction, including eddy currents in the heating layer. These eddy currents produce Joule's heat, with which the heating layer is heated.

The fixing apparatus disclosed in Japanese Patent Application Laid-Open No. 2000-268952 mentioned above requires two exciting coils, i.e., the first and second coils. This makes this fixing apparatus comparatively expensive and large.

Moreover, in the fixing apparatus described above, while the carrier member is provided with a heater, the pressure member that forms a nip between itself and the carrier member is not provided with a heater. Thus, the pressure member is heated only with the heat it receives from the carrier member. Even once the pressure member is heated to a temperature close to that of the carrier member, as paper is passed, it snatches away the heat of the pressure member, making it less hot immediately. To recover the temperature of the pressure member, it needs to be brought into contact with the carrier member again. However, as long as paper is fed continuously, it is impossible to secure a sufficient time for their contact. Ultimately, the pressure member may remain less hot, resulting in poorer fixing performance than is expected.

A heating member for induction heating is commonly formed of a magnetic metal. However, it is known that even a non-magnetic metal offers higher heating efficiency than a magnetic metal, provided that the heating member is made sufficiently thin. The fixing apparatus disclosed in Japanese Patent Application Laid-Open No. 2000-268952 includes a construction in which a thin layer of a non-magnetic metal is used as a heating layer. However, this construction cannot be said to achieve heating by fully exploiting the properties of a non-magnetic metal, which is inherently difficult to heat by induction heating.

In the fixing apparatus disclosed in Japanese Patent Application Laid-Open No. 2000-268952 mentioned above, the exciting coils are arranged so as to sandwich the carrier member from both sides. To realize this construction, the exciting coils need to be located away from the nip, through which paper is passed. This causes heat to escape from the heated part of the carrier member before it reaches the nip, and thus the energy fed from the exciting coils to the heating member is not efficiently conducted to paper. Making an allowance for the expected drop in temperature when setting the target temperature to which to heat the carrier member leads to increased electric power consumption. How heat is dissipated from the carrier member depends on the ambient conditions such as temperature and humidity, and therefore, if there is a long distance from the exciting coils to the nip, it makes unstable the temperature of the carrier member as it passes through the nip.

Moreover, when a heating layer made of a non-magnetic metal is heated by induction heating, the magnetic field produced by exciting coils is transmitted through the heating layer, with the result that metal components located nearby are heated unnecessarily, leading to a waste of energy and an unduly high temperature inside the apparatus. In the fixing apparatus disclosed in Japanese Patent Application Laid-Open No. 2000-268952, an attempt is made to prevent leakage of the magnetic flux by arranging the exciting coils so as to sandwich the heating layer. The effect of this arrangement, however, cannot be said to be satisfactory.

In a case where electromagnetic induction heating is applied in a fixing apparatus provided with a fixing roller and a pressure roller, and where exciting coils are built into the fixing roller, the interior of the fixing roller becomes hot owing to the heat radiated from the heated fixing roller itself and the heat dissipated from the exciting coils. The exciting coils are typically combined with a ferrite core for the purpose of intensifying the magnetic field. Ferrite changes its properties according to temperature, and loses one of its characteristic properties, namely high magnetic permeability, at temperatures over 200° C. This may make it impossible to achieve the desired intensification of the magnetic field.

SUMMARY OF THE INVENTION

An object of the present invention is to provide a fixing apparatus of an induction heating type that efficiently heats a heating layer and that operates with reduced electric power consumption and with a short warm-up time.

Another object of the present invention is to provide a fixing apparatus that effectively prevents leakage of a magnetic flux and thereby prevents metal components located around the fixing apparatus from being heated unnecessarily.

Still another object of the present invention is to provide a fixing apparatus that, even when leakage of a magnetic flux is attempted by combining a high magnetic permeability material such as ferrite with exciting coils built into a fixing roller, can reduce the influence of heat on the high magnetic permeability material.

A further object of the present invention is to provide a fixing apparatus of an induction heating type that can be produced at low cost and in a compact structure.

To achieve the above objects, according to one aspect of the present invention, a fixing apparatus is provided with:

(a) a fixing member that is composed of a support member formed of a ferromagnetic material and a heating layer formed adjacent thereto in the form of a thin film of a non-magnetic, electrically conductive material; and (b) an exciting coil that, when energized with a high-frequency electric current, produces a high-frequency magnetic field, thereby produces induced eddy currents in the heating layer of the fixing member, thereby produces Joule's heat in the heating layer, and thereby heats the fixing member.

In this construction, the heating layer is formed as a non-magnetic, electrically conductive thin film. This helps reduce the heat capacity of the heating layer, and thus makes efficient heating possible. Moreover, a leaking magnetic flux is absorbed by the ferromagnetic-material support member. This helps reduce the influence of a magnetic flux leaking from the magnetic field source (exciting coil) on metal parts and the like located around the fixing apparatus.

According to the present invention, in the fixing apparatus constructed as described above, temperature measuring means for measuring the temperature of the heating layer is provided inside the fixing member. In this construction, the temperature measuring means can be disposed near the nip through which paper is passed. This makes it possible to accurately measure the temperature at the nip and to precisely control the temperature.

According to the present invention, in the fixing apparatus constructed as described above, the heating layer is provided on the outer circumferential surface of the support member, with another heating layer provided on the surface of a pressure member that makes contact with the fixing member, and with the exciting coil disposed outside but near the fixing and pressure members. In this construction, the heating layers of both the fixing and pressure members generate heat. This makes it possible to efficiently heat paper from both sides to ensure firmer fixing of toner on the paper.

According to another aspect of the present invention, a fixing apparatus is provided with:

(a) a fixing member that fixes unfixed toner on paper;

(b) a pressure member that makes contact with the fixing member to form in between a nip through which paper is passed and that is provided with a heating layer formed of a magnetic metal; and (c) an exciting coil that is disposed outside the pressure member.

In this construction, the exciting coil makes the heating layer of the pressure member generate heat. This makes it possible to heat the pressure member even while paper is being passed. This alleviates the lowering of the temperature of the pressure member resulting from its heat being snatched away by paper, and thus helps obtain stable fixing performance.

According to the present invention, in the fixing apparatus constructed as described above, the fixing member is provided with a heating layer formed of a non-magnetic metal, with the exciting coil disposed inside the fixing member, near the portion thereof where the fixing and pressure members make contact with each other. In this construction, the magnetic flux emanating from inside the fixing member permeates through the non-magnetic-metal heating layer and reaches the magnetic-metal heating layer. Thus, the two heating layers can be made to generate heat simultaneously by the exciting coil shared between them. This results in high heating efficiency. Moreover, there is no need to provide separate exciting coils for the fixing and pressure members. This helps reduce the number of components and thereby reduce the cost and simplify the construction.

According to the present invention, in the fixing apparatus constructed as described above, a high magnetic permeability member is disposed near the exciting coil. In this construction, most of the magnetic flux produced by the exciting coil passes through the high magnetic permeability member. This helps intensify the magnetic field, and makes it easy to grasp where the magnetic flux is passing. As a result, it is possible to control the positions in the fixing and pressure members where heating takes place. Moreover, the high magnetic permeability member helps improve the inductance, and thus makes it possible to make the exciting coil compact.

According to the present invention, in the fixing apparatus, constructed as described above, the magnetic-metal heating layer of the pressure member is given a thickness greater than the magnetic field permeation depth. If the thickness of the magnetic-metal heating layer is smaller than the magnetic field permeation depth, the magnetic flux produced by the exciting coil passes through the heating layer and becomes a leaking magnetic flux. This does not occur when the thickness of the heating layer is greater than the magnetic field permeation depth. Thus, if another metal member is provided inside the magnetic-metal heating layer of the pressure member, this metal member is not heated unnecessarily. This helps prevent a waste of energy.

According to the present invention, in the fixing apparatus constructed as described above, a heat insulating layer is provided inside the magnetic-metal heating layer of the pressure member. With this construction, it is possible to reduce the heat capacity of the pressure member. As a result, it is possible to reduce the time required for the surface of the pressure member to reach the temperature suitable for fixing. Moreover, it is possible to reduce electric power consumption.

According to another aspect of the present invention, a fixing apparatus is provided with:

(a) a fixing member that fixes unfixed toner on paper and that is provided with a heating layer formed of a magnetic metal;

(b) a pressure member that makes contact with the fixing member to form in between a nip through which paper is passed; and (c) an exciting coil that is disposed outside the fixing member.

In this construction, the fixing member can be heated directly by the shared exciting coil disposed outside the fixing member. The exciting coil can be disposed at or near the nip. This permits the energy fed from the exciting coil to the heating layer to be sufficiently conducted, in the form of heat, to paper. This helps obtain high heating efficiency and reduce electric power consumption. Alternatively, the exciting coil may be disposed inside the pressure member so as to heat the nip while paper is being passed. This alleviates the lowering of the temperature of the pressure member resulting from its heat being snatched away by paper, and thus helps obtain stable fixing performance.

According to the present invention, in the fixing apparatus constructed as described above, the pressure member is provided with a heating layer formed of a non-magnetic metal, with the exciting coil disposed inside the pressure member, near the portion thereof where the pressure and fixing members make contact with each other. In this construction, the magnetic flux emanating from inside the pressure member permeates through the non-magnetic-metal heating layer and reaches the magnetic-metal heating layer. Thus, the two heating layers can be made to generate heat simultaneously by the exciting coil shared between them. This results in high heating efficiency. Moreover, there is no need to provide separate exciting coils for the fixing and pressure members. This helps reduce the number of components and thereby reduce the cost and simplify the construction. Furthermore, the pressure member can also be heated. This helps reduce variation in the temperature of the pressure member, and thus helps obtain stable fixing performance.

According to the present invention, in the fixing apparatus constructed as described above, a high magnetic permeability member is disposed near the exciting coil. In this construction, most of the magnetic flux produced by the exciting coil passes through the high magnetic permeability member. This helps intensify the magnetic field, and makes it easy to grasp where the magnetic flux is passing. As a result, it is possible to control the positions in the fixing and pressure members where heating takes place. Moreover, the high magnetic permeability member helps improve the inductance, and thus makes it possible to make the exciting coil compact.

According to the present invention, in the fixing apparatus constructed as described above, the magnetic-metal heating layer of the fixing member is given a thickness greater than the magnetic field permeation depth. If the thickness of the magnetic-metal heating layer is smaller than the magnetic field permeation depth, the magnetic flux produced by the exciting coil passes through the heating layer and becomes a leaking magnetic flux. This does not occur when the thickness of the heating layer is greater than the magnetic field permeation depth. Thus, if another metal member is provided inside the magnetic-metal heating layer of the pressure member, this metal member is not heated unnecessarily. This helps prevent a waste of energy.

According to the present invention, in the fixing apparatus constructed as described above, a heat insulating layer is provided inside the magnetic-metal heating layer of the fixing member. With this construction, it is possible to reduce the heat capacity of the fixing member. As a result, it is possible to reduce the time required for the surface of the fixing member to reach the temperature suitable for fixing. Moreover, it is possible to reduce electric power consumption.

According to another aspect of the present invention, a fixing apparatus is provided with:

(a) a fixing member that fixes unfixed toner on paper and that is provided with a heating layer formed of a magnetic metal and a heating layer formed of a non-magnetic metal, the non-magnetic-metal heating layer being kept in intimate contact with the outer surface of the magnetic-metal heating layer;

(b) a pressure member that makes contact with the fixing member to form in between a nip through which paper is passed; and (c) an exciting coil that is disposed outside the fixing member.

In this construction, the fixing member has the magnetic-metal heating layer and the non-magnetic-metal heating layer kept in intimate contact with each other. This permits the shared exciting coil to make the two heating layers generate heat simultaneously. As a result, it is possible to achieve stable heating more easily than in a case where a non-magnetic-metal heating layer and a magnetic-metal heating layer are used separately. This helps obtain high heating efficiency.

According to the present invention, in the fixing apparatus constructed as described above, a high magnetic permeability member is disposed outside the fixing member, near the exciting coil. In this construction, most of the magnetic flux produced by the exciting coil passes through the high magnetic permeability member. This helps intensify the magnetic field, and makes it easy to grasp where the magnetic flux is passing. As a result, it is possible to control the positions in the fixing and pressure members where heating takes place. Moreover, the high magnetic permeability member helps improve the inductance, and thus makes it possible to make the exciting coil compact.

According to another aspect of the present invention, a fixing apparatus is provided with:

(a) a fixing member that fixes unfixed toner on paper and that is provided with a heating layer formed of a magnetic metal and a heating layer formed of a non-magnetic metal, the non-magnetic-metal heating layer being kept in intimate contact with the inner surface of the magnetic-metal heating layer;

(b) a pressure member that makes contact with the fixing member to form in between a nip through which paper is passed; and (c) an exciting coil that is disposed inside the fixing member, near the portion thereof where the fixing and pressure members make contact with each other.

In this construction, the fixing member has the magnetic-metal heating layer and the non-magnetic-metal heating layer kept in intimate contact with each other. This permits the shared exciting coil to make the two heating layers generate heat simultaneously. As a result, it is possible to achieve stable heating more easily than in a case where a non-magnetic-metal heating layer and a magnetic-metal heating layer are used separately. This helps obtain high heating efficiency. Furthermore, the magnetic-metal heating layer is disposed outside the non-magnetic-metal heating layer with respect to the exciting coil disposed inside the fixing member. This makes it possible to prevent leakage of a magnetic flux to outside the fixing apparatus and thereby prevent metal parts located around the fixing apparatus from being heated unnecessarily.

According to the present invention, in the fixing apparatus constructed as described above, a high magnetic permeability member may be disposed inside the fixing member. In this construction, most of the magnetic flux produced by the exciting coil passes through the high magnetic permeability member. This helps intensify the magnetic field, and makes it easy to grasp where the magnetic flux is passing. As a result, it is possible to control the positions in the fixing and pressure members where heating takes place. Moreover, the high magnetic permeability member helps improve the inductance, and thus makes it possible to make the exciting coil compact.

BRIEF DESCRIPTION OF THE DRAWINGS

This and other objects and features of the present invention will become clear from the following description, taken in conjunction with the preferred embodiments with reference to the accompanying drawings in which:

FIG. 14 is a table showing the relationship between the eddy current load and thickness of the non-magnetic-metal heating layer and the influence of the eddy current load on the amount of heat generated;

DESCRIPTION OF THE PREFERRED EMBODIMENTS

A first embodiment of the invention will be described with reference to the drawings.

Figure 1:
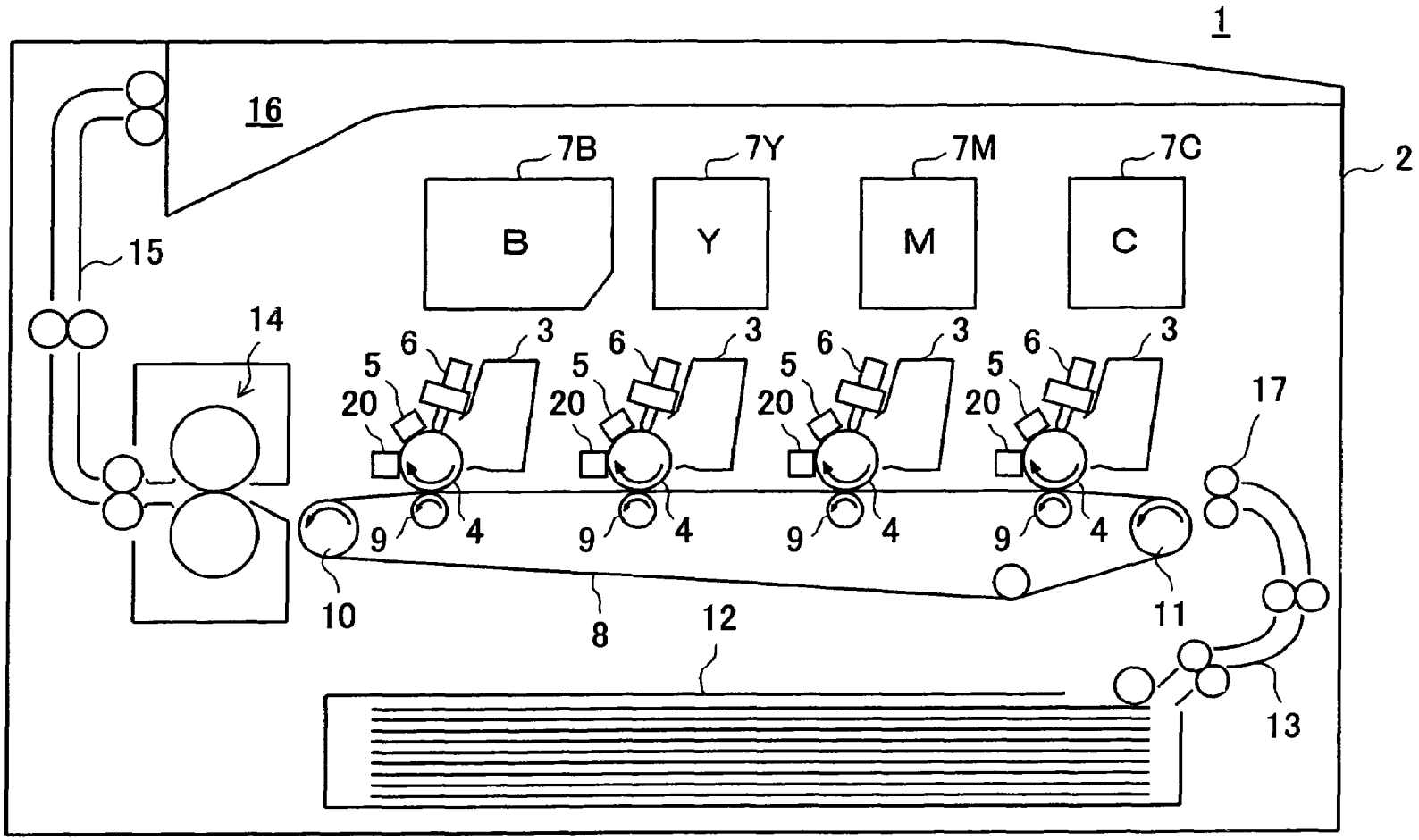
FIG. 1 is a schematic sectional view showing an outline of the construction of an image forming apparatus incorporating a fixing apparatus according to the invention.

FIG. 1 shows an outline of the construction of an image forming apparatus incorporating a fixing apparatus according to the invention. A printer 1 is presented as an example of an image forming apparatus. The printer 1 incorporates, inside a body 2, developing apparatuses 3, one for each of cyan, magenta, yellow, and black colors. The developing apparatuses 3 are each provided with a photoconductive drum 4 having a photoconductive layer formed of amorphous silicon or the like. The photoconductive drum 4 rotates in the direction indicated by an arrow in the figure.

The surface of the photoconductive drum 4 is uniformly charged by a charger 5. When the charged surface of the photoconductive drum 4 is irradiated with LED light emitted from an LED print head unit 6 according to original image data fed from an external computer or the like, an electrostatic latent image is formed on the surface of the photoconductive drum 4. Toner attaches to this electrostatic latent image and thereby forms a toner image. From toner feed containers 7C, 7M, 7Y, and 7B, toners of cyan, magenta, yellow, and black colors are fed to the corresponding developing apparatuses 3.

Under the photoconductive drums 4 for the different colors, which are arranged side by side horizontally, there is disposed a paper transport belt 8. The paper transport belt 8 is pressed against the photoconductive drums 4 by transfer rollers 9. The paper transport belt 8 is endless, and is put around a drive roller 10 and a idler roller 11. When the drive roller 10 is rotated by an unillustrated motor, the paper transport belt 8 is so driven that its surface at which it makes contact with the photoconductive drums 4 moves in the same, i.e., forward, direction as the circumferential surfaces of the photoconductive drums 4.

Paper is fed from a paper feed mechanism 12 through a paper transport passage 13 toward the paper transport belt 8. Before the paper rides on the paper transport belt 8, the timing of paper feed operation is controlled by resist rollers 17 so that the paper will pass each photoconductive drum 4 with such timing as to permit the transfer rollers 9 to transfer the image into an appropriate position on the paper.

After the adjustment of the timing, the resist rollers 17 are driven so that the paper is fed onto the paper transport belt 8. As the paper is transported under the photoconductive drums 4 by the paper transport belt 8, toner images of the different colors are transferred onto the paper one after another. When the toner images from all the photoconductive drums 4 have been transferred onto the paper, the paper is transported to a fixing apparatus 14 of an induction heating (IH) type according to the invention so that those images are fixed as a color image. Having passed between a pair of rollers provided in the fixing apparatus 14, the paper enters a paper transport passage 15, and is then ejected from the paper transport passage 15 into an ejected paper rack 16.

Not all the toner that has attached to the surface of the photoconductive drums 4 is transferred onto the paper; that is, some of the toner remains on the surfaces of the photoconductive drums 4. For this reason, each photoconductive drum 4 is provided with a cleaning apparatus 20 for removing the remaining toner.

Figure 2:
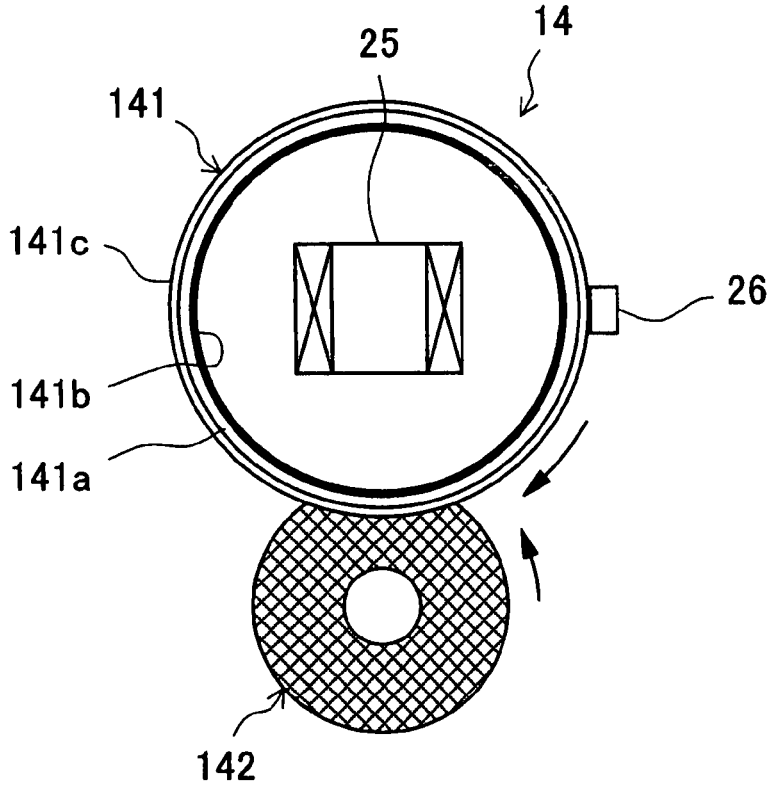
FIG. 2 is a schematic sectional view showing an outline of the construction of the fixing apparatus of a first embodiment of the invention.
Figure 3:
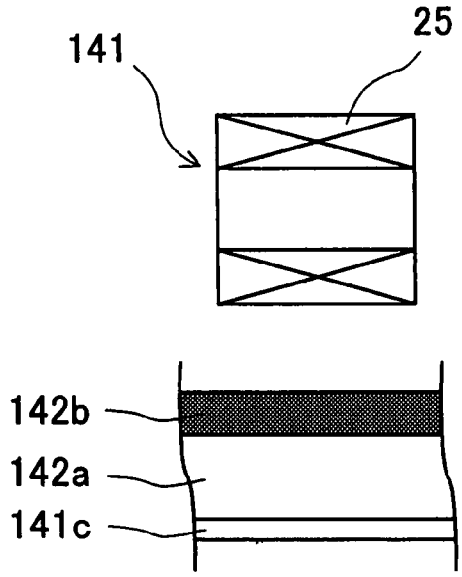
FIG. 3 is a partial sectional view showing an outline of the construction of the fixing roller.

Next, the construction of the fixing apparatus of a first embodiment of the invention will be described with reference to FIGS. 2 and 3. FIG. 2 is a sectional view showing an outline of the construction of the fixing apparatus of the first embodiment, and FIG. 3 is a partial sectional view showing an outline of the construction of the fixing roller.

The fixing apparatus 14 is provided with a fixing roller 141 functioning as a fixing member and a pressure roller 142 functioning as a pressure member. The fixing and pressure rollers 141 and 142 rotate in the directions indicated by arrows in the figure. The fixing roller 141 is made to generate heat by induction heating (1H), and thereby the paper that is passed through the nip between the fixing and pressure rollers 141 and 142 is heated so that the toner carried on the paper is fixed thereon.

The fixing roller 141 is provided with a cylindrical support member 141*a* formed of a ferromagnetic material. In a space secured inside the support member 141*a*, there is disposed an exciting coil 25 for IH. On the inner surface of the support member 141*a*, adjacent thereto, there is formed a heating layer 141*b* in the form of a thin film of a non-magnetic, electrically conductive material. On the outer surface of the support member 141*a*, there is formed a stick-free layer 141*c*.

Placed in contact with the stick-free layer 141*c* is a thermistor 26 for measuring the surface temperature of the fixing roller 141. The pressure roller 142 is kept pressed against the fixing roller 141 so a to form a nip in between.

The pressure roller 142 is formed of elastic, sponge-like resin foam, and forms a nip having a certain width between itself and the fixing roller 141. In this nip having a certain width, pressure as well as heat from the fixing roller 141 is applied to paper to permit toner to be fixed thereon. By forming the pressure roller 142 with resin foam in this way, it is possible to reduce the heat capacity of the pressure roller 142.

The coil portion of the exciting coil 25 is wound in a spiral shape along the rotation axis of the fixing roller 141. When a high-frequency electric current from an unillustrated high-frequency electric power source is passed through the exciting coil 25, the exciting coil 25 produces a high-frequency magnetic field. This high-frequency magnetic field produces induced eddy currents in the heating layer 141*b*, and the resulting Joule's heat makes the heating layer 141*b* generate heat. This raises the temperature of the fixing roller 141 as a whole.

The heating layer 141*b* is formed of a non-magnetic, electrically conductive material such as copper, aluminum, or non-magnetic stainless steel (for example, the type identified as SUS304 in the Japanese Industrial Standards). The heating layer 141*b* is formed by plating or vapor-depositing the non-magnetic, electrically conductive material on the inner surface of the support member 141*a*.

The heating layer 141*b* heated by the exciting coil 25 acts as a load of the exciting coil 25. If the load is too low, the internal resistance of the high-frequency electric power source itself lowers heating efficiency. If the load is so high as to exceed the capacity of the high-frequency electric power source, it is impossible to achieve sufficient heating. Accordingly, the layer thickness of the heating layer 141*b* (the magnetic field permeation depth) needs to be set appropriately. The layer thickness of the heating layer 141*b* (the magnetic field permeation depth) is determined according to the formula below.

$$\text{Magnetic Field Permeation Depth } \delta = \sqrt{(2/\mu\sigma\omega)} = \sqrt{(2\rho/\mu\omega)} = 503\sqrt{(\rho/f\mu')}$$

where $\mu$ represents the magnetic permeability (H/m);

$\sigma$ a represents the electric conductivity (1/Ω·m);

$\omega$ represents the angular frequency (=2πf)(1/sec);

f represents the frequency (Hz)

$\rho$ represents the resistivity (Ω·m);

$\mu'$ represents the relative magnetic permeability ($\mu/\mu_0$).

Figure 4:
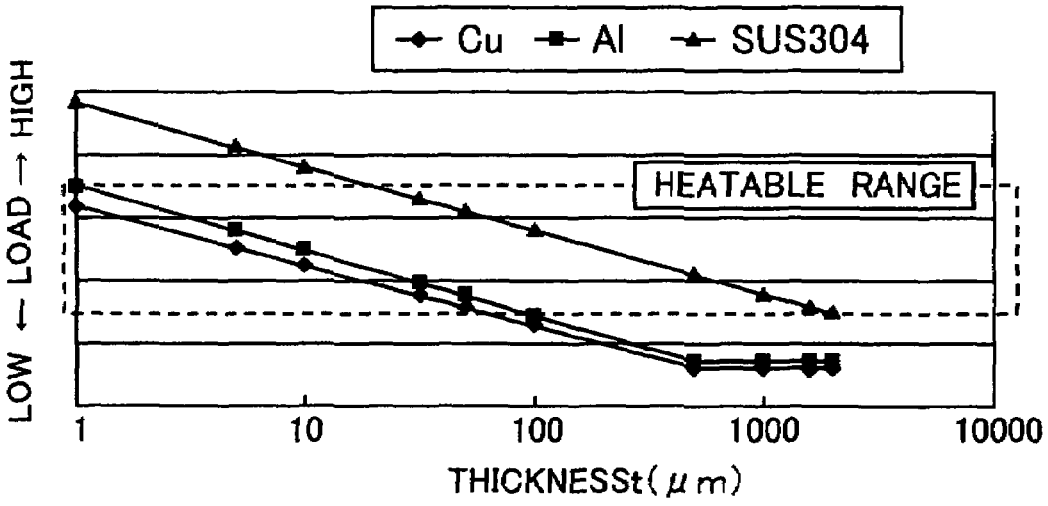
FIG. 4 is a graph showing the relationship between the thickness of the heating layer and the load, with heating layers formed of different materials.

When the frequency is about 30 kHz, the relationship between the layer thickness of the heating layer 141*b* and the load, as observed with heating layers formed of different materials, is as shown in FIG. 4. When the material is copper (with a resistivity of $1.67\times10^{-8}$ (Ω·cm) and a relative magnetic permeability of 1), it is preferable that the heating layer 141*b* be given a layer thickness in the range from about 1 μm to about 70 μm. When the material is aluminum (with a resistivity of $2.66\times10^{-8}$ (Ω·cm) and a relative magnetic permeability of 1), it is preferable that the heating layer 141*b* be given a layer thickness in the range from about 0.5 μm to about 60 μm. When the material is non-magnetic stainless steel, for example SUS304 with a resistivity of $7.20\times10^{-7}$ (Ω·cm) and a relative magnetic permeability of 1, it is preferable that the heating layer 141*b* be given a layer thickness in the range from about 50 μm to about 1 000 μm.

As the frequency is increased (for example to about 100 kHz), the magnetic field permeation depth 5 becomes smaller, and thus the heating layer 141*b* acts as a heavier load. This makes efficient heating possible with a 1 mm or more thick layer of copper or aluminum.

The heating layer 141*b* can be made to generate heat in the conventional frequency range (from about 20 kHz to about 100 kHz). Thus, the heating layer 141*b* can be made to generate heat efficiently with low noise and at low cost.

The support member 141*a* is formed of a ferromagnetic material, for example iron or nickel. The layer thickness of the support member 141*a* is so adjusted that the support member 141*a* has a sufficiently high heat capacity to absorb a magnetic flux leaking from the magnetic field source and to alleviate temperature ripples. For example, in a case where the heating layer 141*b* is formed so as to fulfill the conditions described above, when the support member 141*a* is formed of iron, it is preferable that it be given a layer thickness in the range from about 5 μm to 2 000 μm; also when the support member 141*a* is formed of nickel, it is preferable that it be given a layer thickness in the range from about 5 μm to 2 000 μm.

The heating layer 141*b* formed on the inner surface of the support member 141*a* is located between the support member 141*a* and the exciting coil 25. The stick-free layer 141*c* formed on the outer surface of the support member 141*a* is for facilitating the separation of paper from the fixing roller 141, and is formed of fluorocarbon resin.

Between the support member 141*a* and the stick-free layer 141*c*, there may be additionally laid a layer of an elastic material such as silicone rubber. This helps increase the heat capacity and give elasticity to the surface of the fixing roller 141. In that case, it is preferable that the silicone rubber layer be given a thickness of about 0.1 mm or more. With silicone rubber laid in this way, when paper is passed through the nip between the fixing and pressure rollers 141 and 142, the fixing roller 141 elastically makes contact with the paper. This enhances the intimacy with which the fixing roller 141 makes contact with the toner on the paper, resulting in better image quality after fixing. This makes the fixing apparatus 14 suitable for full-color printing.

The support member 141*a*, which is formed of iron, nickel, or the like, has a higher heat capacity than the heating layer 141*b*, which is formed of copper, aluminum, or the like. This suppresses abrupt variations in the temperature of the heating layer 141*b*. By adjusting the heat capacity of the support member 141*a*, it is possible to adjust the degree of temperature ripples in the heating layer 141*b*.

Since the exciting coil 25 is disposed inside the fixing roller 141, no heat is radiated from the fixing roller 141, and this alleviates the rise in the temperature of the exciting coil 25.

Moreover, it is easy to realize a mechanism for sending cold wind to the exciting coil 25 inside the fixing roller 141 and thereby prevent faults resulting from a rise in the temperature of the exciting coil 25.

Figure 5:
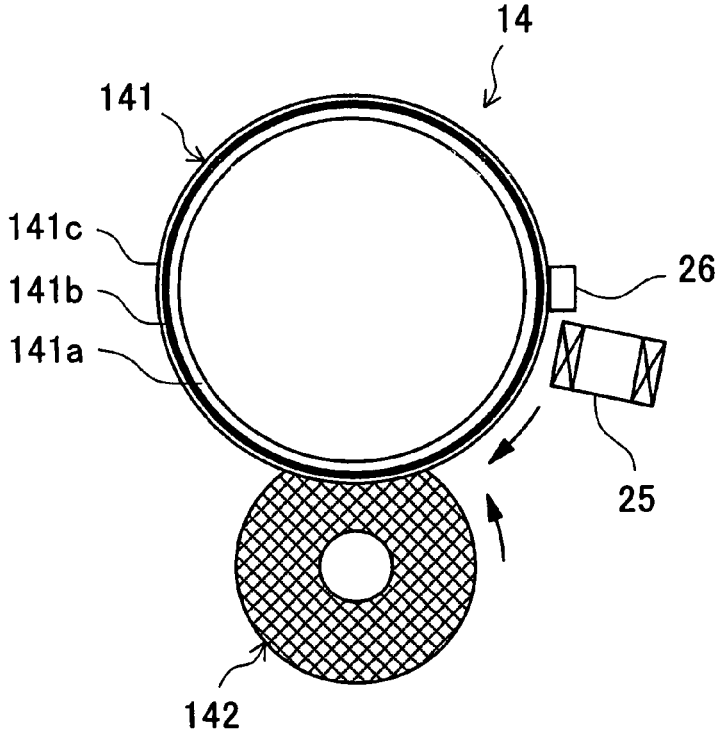
FIG. 5 is a schematic sectional view showing an outline of the construction of the fixing apparatus of a second embodiment of the invention.

Next, the construction of the fixing apparatus of a second embodiment of the invention will be described with reference to FIG. 5. FIG. 5 is a sectional view showing an outline of the construction of the fixing apparatus of the second embodiment. The construction of the second embodiment is basically the same as that of the first embodiment, and therefore, in the following descriptions, such components as are found also in the first embodiment are identified with the same reference numerals, and their explanations will not be repeated. The same applies to the third to fifth embodiments described later.

In the fixing apparatus 14 of the second embodiment, the exciting coil 25 is disposed outside the fixing roller 141 so as to face the surface of the fixing roller 141. In this case, by disposing the exciting coil 25 near the nip between the fixing and pressure rollers 141 and 142, it is possible to efficiently heat only the portion of the heating layer 141*b* that is nearing the nip at every moment.

By using as the thermistor 26 a non-contact-type thermistor that offers satisfactorily fast response, it is possible to eliminate friction between the stick-free layer 141*c* formed at the surface of the fixing roller 141 and the thermistor 26. This helps prolong the life of the fixing roller 141, in particular its stick-free layer 141*c*.

In a case where the exciting coil 25 is disposed outside the fixing roller 141 in this way, the heating layer 141*b* is formed on the outer surface of the support member 141*a*, and the stick-free layer 141*c* is formed further outside, i.e., on the outer surface of the heating layer 141*b*. In the fixing apparatus 14 of the second embodiment, the support member 141*a* and the heating layer 141*b* are respectively formed of the same material and have the same thickness as those used in the fixing apparatus 14 of the first embodiment.

With the fixing roller 141 having the support member 141*a* and the heating layer 141*b* constructed as described above, since the heating layer 141*b* is a non-magnetic, electrically conductive thin film, the heating layer 141*b* has a low heat capacity. This makes efficient heating possible. Moreover, with the heating layer 141*b* disposed adjacent to the support member 141*a*, a magnetic flux leaking from the magnetic field source is absorbed by the support member 141*a*. This helps reduce the influence of a leaking magnetic flux on metal parts located around the fixing apparatus 14.

Moreover, with the fixing apparatus 14 of the second embodiment, it is possible to concentrate the high-frequency magnetic field produced by the exciting coil 25 so as to narrow down the heated region and thereby make the support member 141*a* act like a yoke. This helps enhance the heating efficiency of the heating layer 141*b*. This makes it possible to make the heating layer 141*b* generate sufficient heat without adopting, for example, a construction in which exciting coils are arranged inside and outside the heating layer 141*b* so that a magnetic flux permeates through and thereby heats the heating layer 141*b* (see Japanese Patent Application Laid-Open No. 2000-268952).

Figure 6:
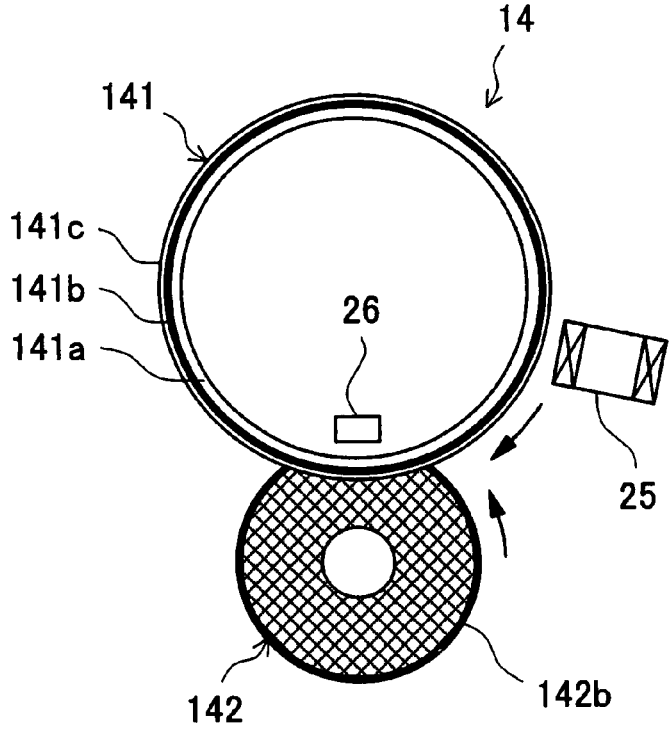
FIG. 6 is a schematic sectional view showing an outline of the construction of the fixing apparatus of a third embodiment of the invention.

Next, the construction of the fixing apparatus of a third embodiment of the invention will be described with reference to FIG. 6. FIG. 6 is a sectional view showing an outline of the construction of the fixing apparatus of the third embodiment.

In the fixing apparatus 14 of the third embodiment, as in the second embodiment, the exciting coil 25 is disposed outside the fixing roller 141. A difference from the second embodiment is that another heating layer 142*b* is formed on the surface of the pressure roller 142. Another difference is that the thermistor 26 is disposed inside the fixing roller 141.

With the construction of the third embodiment, the exciting coil 25 makes also the heating layer 142*b* of the pressure roller 142 generate heat. Thus, paper and toner can be heated also from the side of the pressure roller 142.

Moreover, the thermistor 26 is disposed inside the fixing roller 141, and thus does not restrict the placement of the exciting coil 25. The thermistor 26 itself can be disposed in a position corresponding to the nip between the fixing and pressure rollers 141 and 142. This makes it possible to accurately measure the temperature at the nip, and thus to accurately control the temperature of the fixing roller 141 and/or pressure roller 142.

Figure 7:
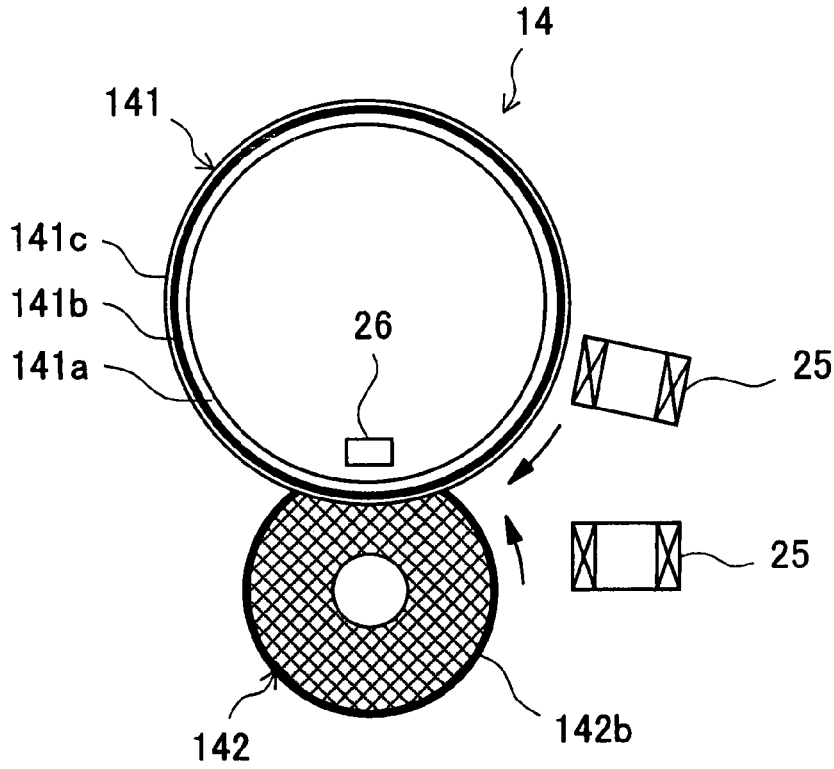
FIG. 7 is a schematic sectional view showing an outline of the construction of the fixing apparatus of a fourth embodiment of the invention.

Next, the construction of the fixing apparatus of a fourth embodiment of the invention will be described with reference to FIG. 7. FIG. 7 is a sectional view showing an outline of the construction of the fixing apparatus of the fourth embodiment.

In the fixing apparatus 14 of the fourth embodiment, as in the third embodiment, the heating layer 142*b* is formed on the surface of the pressure roller 142, and the thermistor 26 is disposed inside the fixing roller 141. A difference from the third embodiment is that exciting coils 25 are provided separately for the heating layer 141*b* of the fixing roller 141 and the heating layer 142*b* of the pressure roller 142.

With the construction of the fourth embodiment, it is possible to make each of the heating layers 141*b* and 142*b* generate heat precisely and thereby surely heat the paper and toner passing through the nip between the fixing and pressure rollers 141 and 142.

Figure 8:
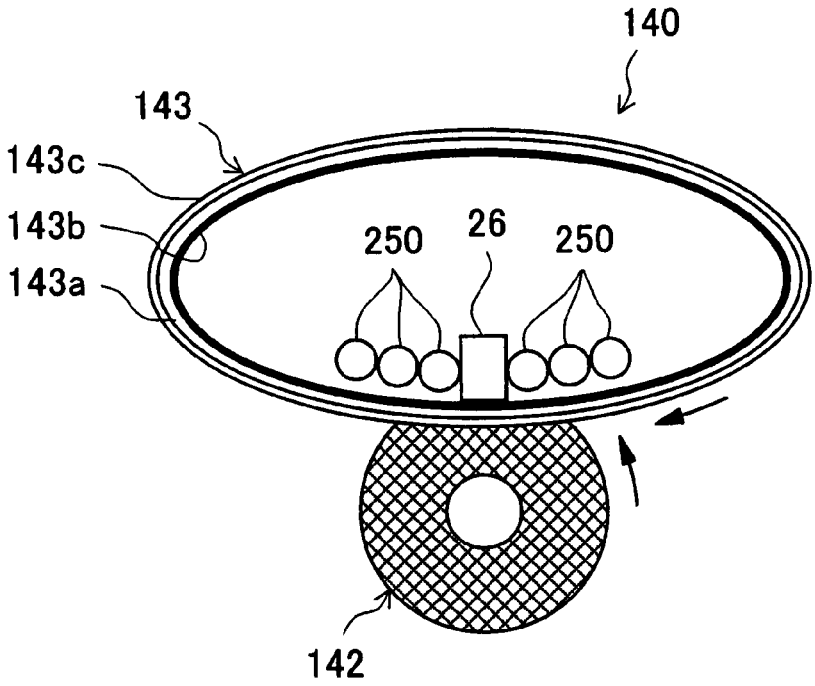
FIG. 8 is a schematic sectional view showing an outline of the construction of the fixing apparatus of a fifth embodiment of the invention.

Next, the construction of the fixing apparatus of a fifth embodiment of the invention will be described with reference to FIG. 8. FIG. 8 is a sectional view showing an outline of the construction of the fixing apparatus of the fifth embodiment.

In the fixing apparatuses 14 of the first to fourth embodiments, the fixing roller 141 functioning as a fixing member and the pressure roller 142 functioning as a pressure member are used in a pair. Instead of using rollers as fixing and pressure members in this way, it is also possible to use a belt as a fixing or pressure member. The fifth embodiment shown in FIG. 8 is an example of a construction in which a belt is used as a fixing member. It should be noted that, in the figure, for simplification's sake, the fixing belt is shown as shorter than it really is.

In the fixing apparatus 140 of the fifth embodiment, an endless fixing belt 143 that rotates in the direction indicated by an arrow in FIG. 8 is pressed against a pressure roller 142 to form a nip, and paper and toner are passed through this nip to be heated so that the toner is fixed on the paper.

The fixing belt 143 is composed of a support member 143*a*, a heating layer 143*b*, and a stick-free layer 143*c*. The heating layer 143*b* is formed on the inner surface of the support member 143*a*. The stick-free layer 143*c* is formed on the outer surface of the support member 143*a*.

Inside the fixing belt 143, there are disposed a plurality of exciting coils 250. The coil portion of each of the exciting coils 250 is wound in a spiral shape along the direction perpendicular to the rotation direction of the fixing belt 143 (i.e., along the depth direction in FIG. 8). It is because the fixing belt 143 is elongate that there are provided a plurality of exciting coils 250, all disposed near the nip between the fixing belt 143 and the pressure roller 142. This permits the high-frequency magnetic field produced by the exciting coils 250 provided in a space secured inside the fixing belt 143 to be concentrated at the nip. This helps narrow down the heated region and thereby enhance the heating efficiency of the heating layer 143*b*.

Inside the fixing belt 143, in a position corresponding to the nip, there is provided a thermistor 26. This makes it possible to accurately measure the temperature at the nip, and thus to accurately control the temperature of the fixing belt 143 (the heating layer 143*b*).

The construction of the fifth embodiment can be modified in the following manner. Specifically, as in the second and third embodiments, another heating layer is formed on the surface of the pressure roller 142, and the exciting coils 250 are disposed outside the fixing belt 143. The heating layer 143*b* is formed on the outer surface of the support member 143*a*, and the stick-free layer 143*c* is formed further outside, i.e., on the outer surface of the heating layer 143*b*. This makes it possible to make the heating layers of both the fixing belt 143 and the pressure roller 142 generate heat so that paper is efficiently heated from both the fixing belt 143 and the pressure roller 142. This helps further enhance the fixability of toner on paper.

Figure 9:
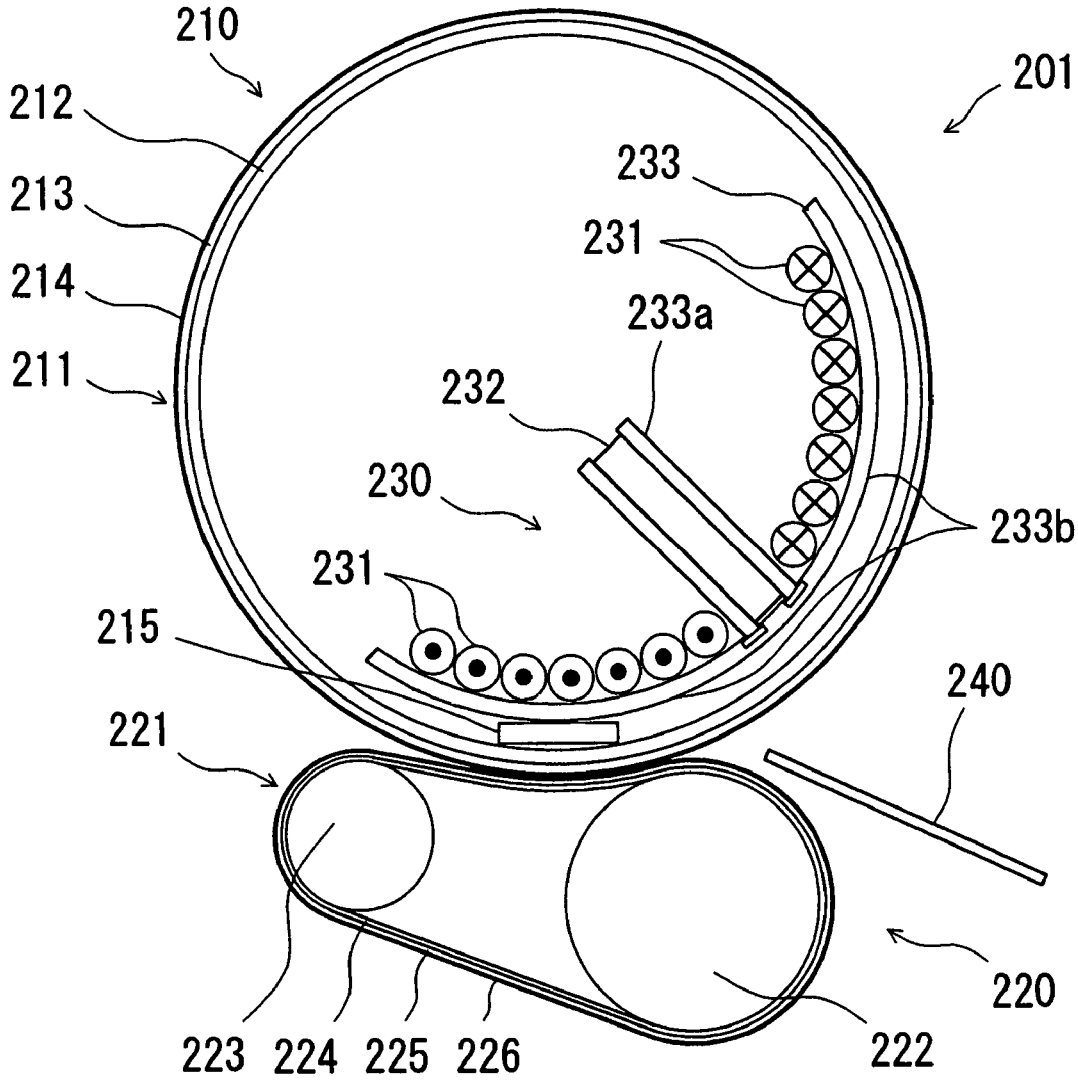
FIG. 9 is a schematic sectional view showing an outline of the construction of the fixing apparatus of a sixth embodiment of the invention.
Figure 10:
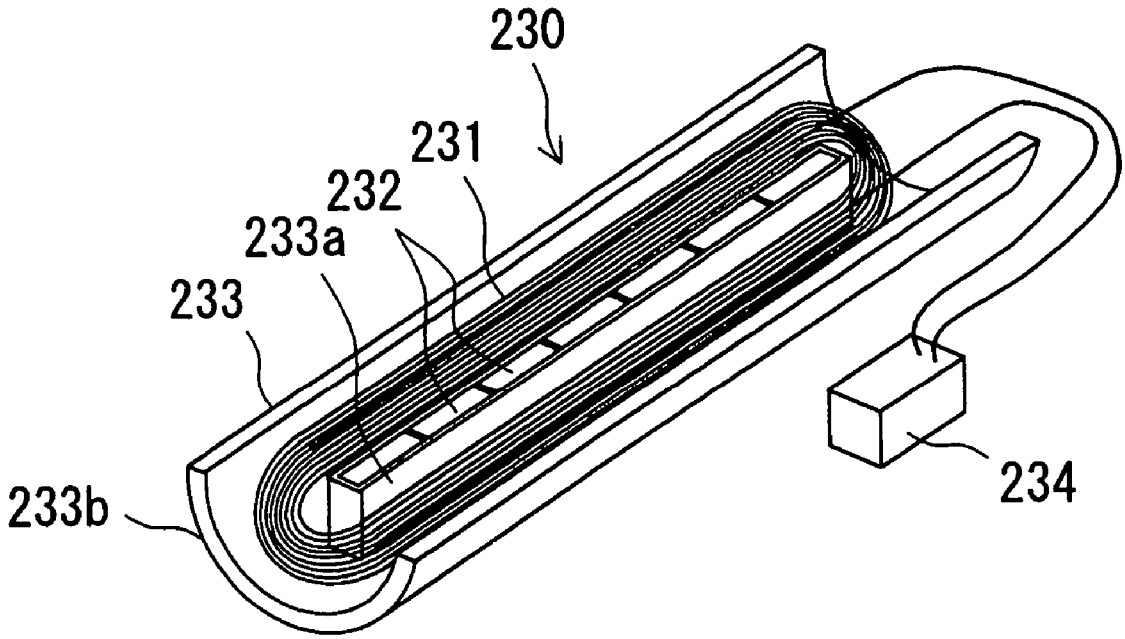
FIG. 10 is a perspective view of the exciting coil portion of the fixing apparatus of the sixth embodiment.

Next, the construction of the fixing apparatus of a sixth embodiment of the invention will be described with reference to FIGS. 9 and 10. FIG. 9 is a schematic sectional view showing an outline of the construction of the fixing apparatus of the sixth embodiment, and FIG. 10 is a perspective view of the exiting coil portion.

The fixing apparatus 201 of the sixth embodiment is provided with a fixing section 210 and a pressure section 220. The fixing section 210 includes a fixing roller 211 functioning as a fixing member. Inside the fixing roller 211, there is disposed an electromagnetic induction section 230. At the place where paper is fed in, there is provided a paper feed guide 240.

The fixing roller 211 is 40 mm across, and has a non-magnetic-metal heating layer 213 laid outside a core member 212 formed of heat-resistant synthetic resin or the like. In a case where the non-magnetic metal is, for example, non-magnetic stainless steel SUS304, the non-magnetic-metal heating layer 213 is given a thickness of 250 μm. Outside the non-magnetic-metal heating layer 213, there is laid a 20 μm thick stick-free layer 214 to make it difficult for toner to attach to the fixing roller 211. The stick-free layer 214 is made of fluorocarbon resin such as PFA (tetrafluoroethylene/per fluoro alkyl vinyl ether copolymer), and is formed by spray coating or by tube laying. There may be additionally laid an elastic layer formed of silicone rubber immediately inside the stick-free layer 214.

The pressure section 220 is composed of a pressure belt 221 functioning as a pressure member, a main roller 222, and a sub roller 223. The pressure belt 221, which makes contact with the fixing roller 211, has a magnetic-metal heating layer 224 formed on a polyimide film (not illustrated). The magnetic-metal heating layer 224 is a 50 μm thick nickel plating layer. Outside the magnetic-metal heating layer 224, there is laid an elastic layer 225. The elastic layer 225 is a 100 μm thick silicone rubber layer. Outside the elastic layer 225, there is laid a stick-free layer 226. The stick-free layer 226 is formed by laying a 50 μm thick PFA tube.

The pressure belt 221 is put around the main roller 222 and the sub roller 223, and is given a predetermined tension. The pressure belt 221 makes contact with the fixing roller 211 so as to form a nip through which paper is passed.

The construction of the fixing and pressure sections 210 and 220 may be reversed so that the fixing section 210 is built with a belt and the pressure section 220 with a roller. Alternatively, both the fixing and pressure sections 210 and 220 may be built with either rollers or belts. In any case, an exciting coil 231, which will be described below, is disposed inside the fixing member, near the portion thereof where the fixing and pressure members make contact with each other. In a case where the fixing roller 211 is replaced with a belt, a non-magnetic-metal heating layer is laid on a polyimide film by plating or by rolling, and a coating of fluorocarbon resin such as PFA is laid further outside.

The electromagnetic induction section 230 is composed of an exciting coil 231, a ferrite core 232, and a support member 233. The exciting coil 231 is formed by winding a litz wire, composed of 300 twisted enamel wires each 0.1 mm across, in the direction along the axis of the fixing roller 211. Inside the exciting coil 231 so wound is disposed the ferrite core 232 for intensifying the magnetic field. The support member 233 is molded of heat-resistant synthetic resin, and is provided with a ferrite core housing portion 233*a* and a curved portion 233*b* formed to fit the curvature of the fixing roller 211.

The exciting coil 231 is so wound as to surround the ferrite core housing portion 233*a* and run along the curved portion 233*b*. To the exciting coil 231 is connected a high-frequency electric power source 234 operating with a rated output of 1 500 W at a frequency of 20 to 50 kHz. The ferrite core 232 may be replaced with a member formed of any other material than ferrite, provided that it has high magnetic permeability.

The electromagnetic induction section 230 is disposed inside the fixing roller 211 with the exciting coil 231 located near the place where the fixing roller 211 and the pressure belt 221 make contact with each other so that a magnetic flux passes through that place.

Inside the fixing roller 211, near the place where the fixing roller 211 and the pressure belt 221 make contact with each other, between the inner wall of the fixing roller 211 and the electromagnetic induction section 230, there is disposed a thermistor 215. This thermistor 215 measures the temperature of the heating portion so that the temperature is controlled by controlling the output of the high-frequency electric power source 234.

It should be understood that any specific values such as dimensions appearing in the descriptions that have been given hitherto and that will be given henceforth are presented merely as preferred examples and are not intended to limit the scope of the invention in any way.

Figure 11:
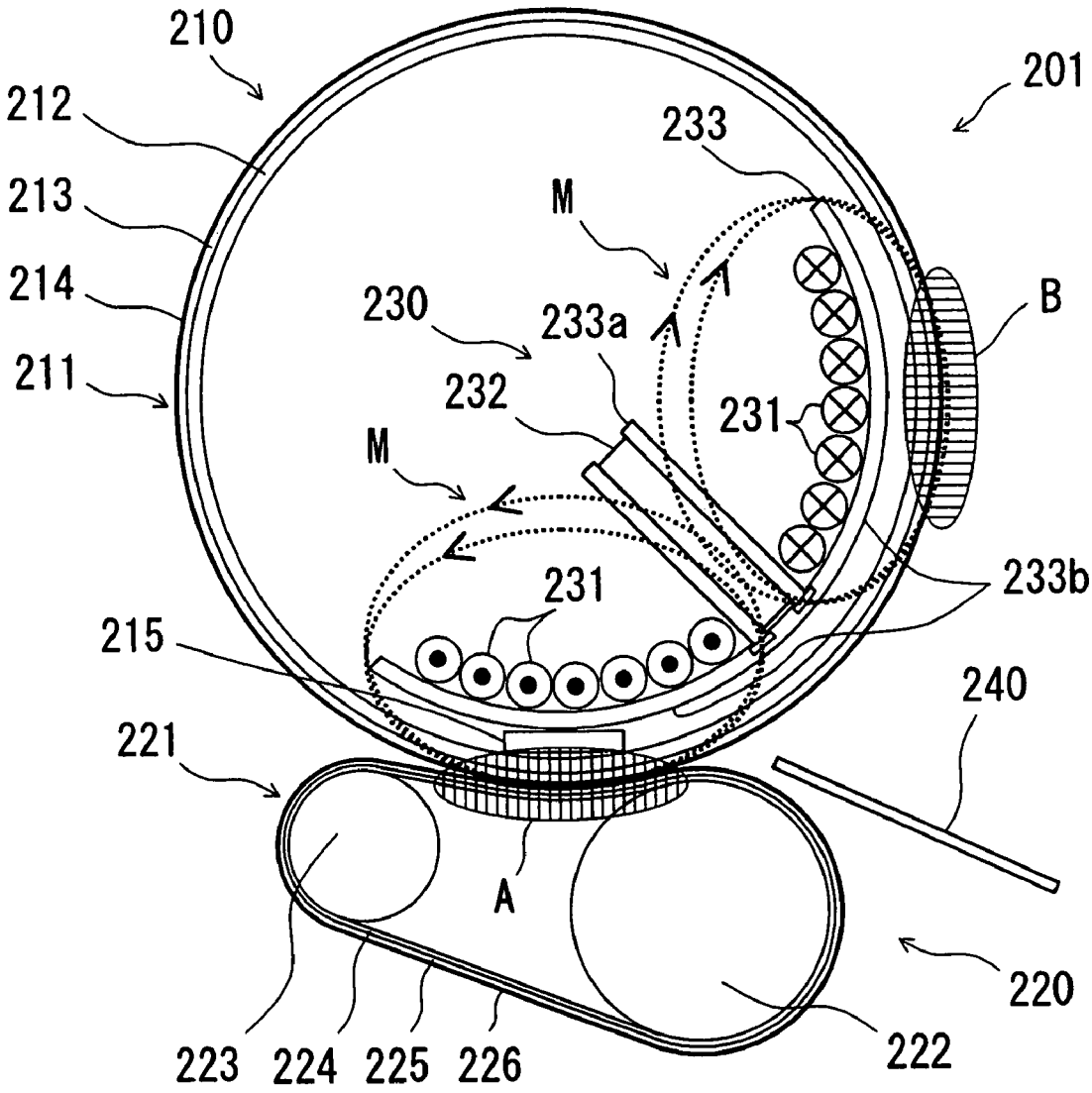
FIG. 11 is a schematic sectional view showing how the fixing apparatus of the sixth embodiment achieves heating.

FIG. 11 is a schematic sectional view showing how the fixing apparatus of the sixth embodiment achieves heating. The fixing apparatus 201 achieves heating in the following manner.

When a high-frequency electric current is passed through the exciting coil 231, a magnetic field is produced. Most of the magnetic flux M of the produced magnetic field passes through the ferrite core 232, which is a high magnetic permeability member, with the result that the magnetic field is intensified. When the produced magnetic flux M passes through the non-magnetic-metal heating layer 213 of the fixing roller 211, eddy currents flow in portions A and B of the metal where the magnetic flux M passes, and the electric resistance of the metal produces Joule's heat there. In particular in the portion A, the presence of the magnetic-metal heating layer 224 causes more intense concentration of the magnetic field and thus produces more heat than in the portion B. The magnetic flux M passes through the non-magnetic-metal heating layer 213 of the fixing roller 211 and reaches the pressure belt 221. Thus, eddy currents flow also in the magnetic-metal heating layer 224 of the pressure belt 221, producing Joule's heat there.

In this way, not only the fixing roller 211 but also the pressure belt 221 can be heated directly. Accordingly, paper passing through the nip receives heat from both sides thereof. This makes it possible to set the temperature of the fixing roller 211 lower. This eliminates the need to feed extra heat, and thus helps obtain high heating efficiency.

Moreover, the pressure belt 221 can be heated even while paper is being passed. Accordingly, even when a sheet of paper that is elongate in the direction in which it is passed is passed, it is possible to reduce the drop in temperature at the rear end of the sheet and thereby obtain stable fixability.

Figure 12:
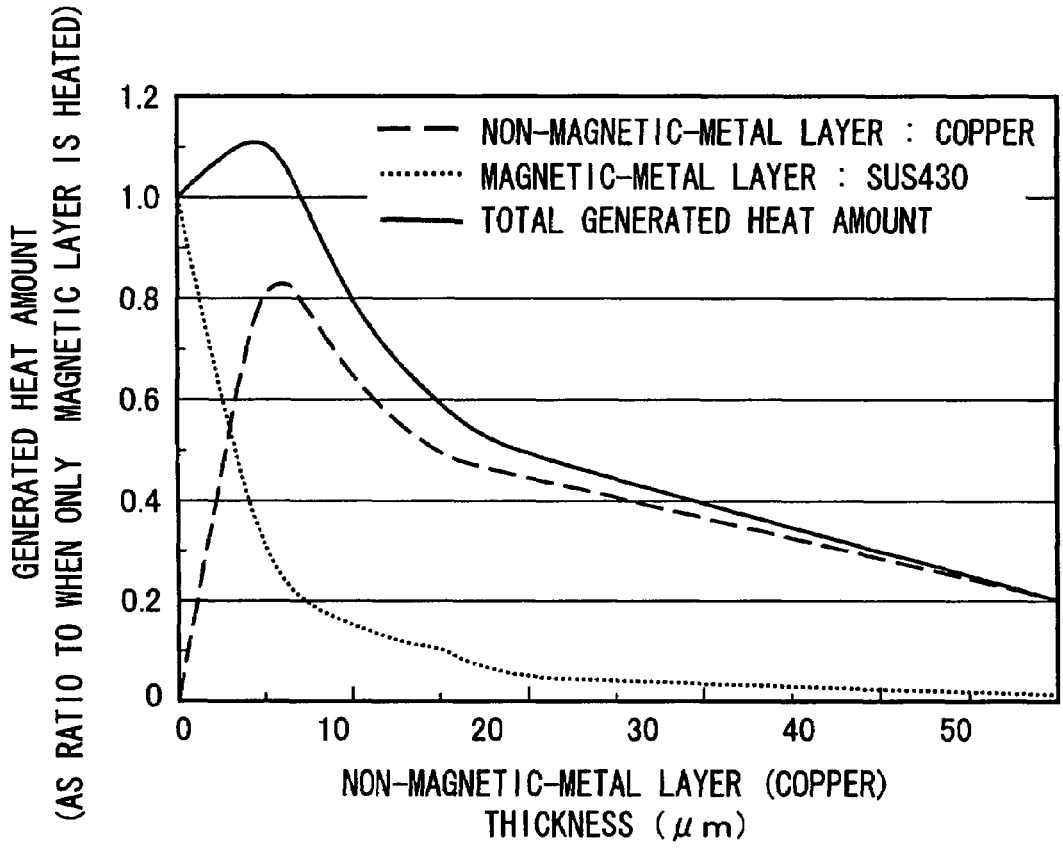
FIG. 12 is a first graph showing the influence of the thickness of the heating layer on the amount of heat generated.

FIG. 12 is a graph showing the influence of the thickness of the copper of which the non-magnetic-metal heating layer of the fixing roller is formed on the amount of heat generated. Along the horizontal axis of the graph is taken the thickness of the copper of which the non-magnetic-metal heating layer 213 is formed, and along the veridical axis are taken the amount of heat generated by each of the heating layers 213 and 214 and the total amount of heat generated by them, assuming that the mount of heat generated by the magnetic-metal heating layer 224 alone is 1. Here, the magnetic-metal heating layer 224 is formed of magnetic stainless steel SUS430 (the number of a type of stainless steel according to the Japanese Industrial Standards).

FIG. 12 shows the following. When the thickness of the copper is 7.0 μm or less, the total amount of heat generated is larger than 1.0. In particular, in the range where the thickness of the copper is from 2.0 μm to 6.0 μm, the total amount of heat generated is close to its peak value. That is, it is possible to obtain higher heating efficiency when the fixing roller 211 and the pressure belt 221 are formed with a non-magnetic metal and a magnetic metal combined together than when they are formed with a magnetic metal alone. By giving the copper a thickness in this range, it is possible to obtain 10% higher heating efficiency.

Figure 13:
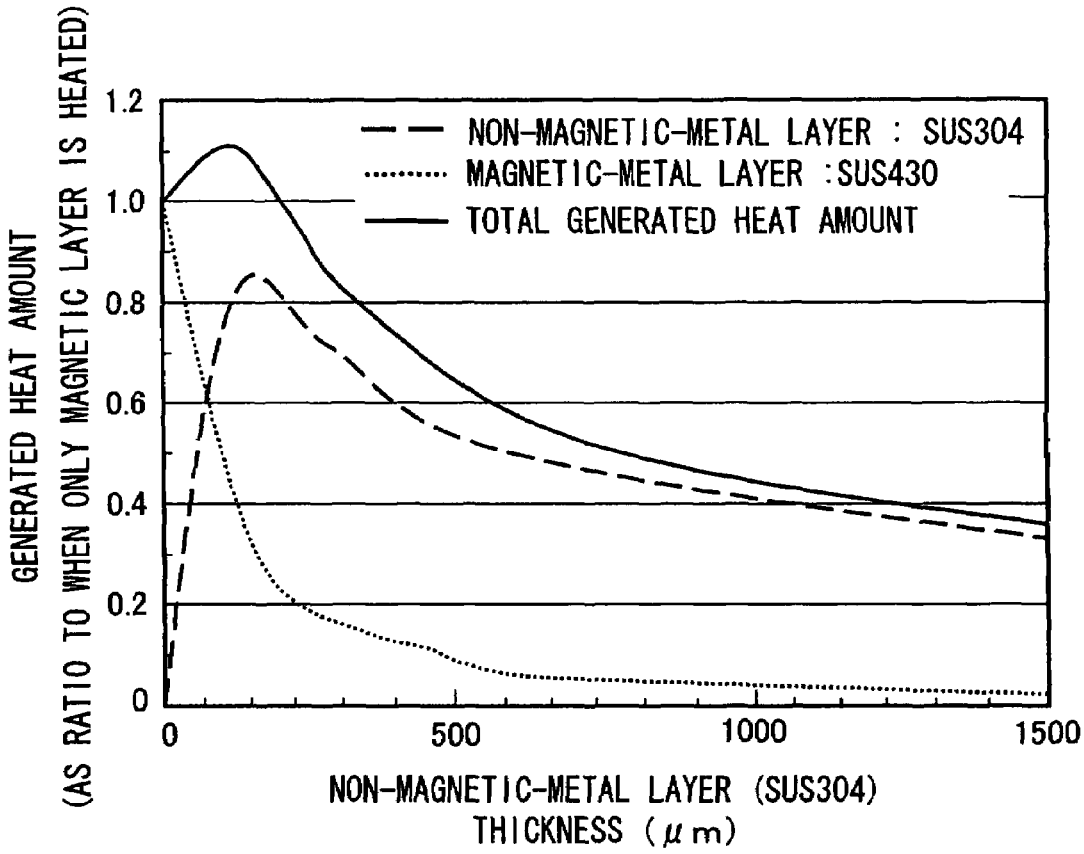
FIG. 13 is a second graph showing how the thickness of the heating layer affects the amount of heat generated.

FIG. 13 is a graph showing the influence of the thickness of the non-magnetic stainless steel SUS304 of which the non-magnetic-metal heating layer of the fixing roller is formed on the amount of heat generated. Here, the graph is constructed in the same manner as in FIG. 12 described above, which deals with copper, and the magnetic-metal heating layer 224 is formed of magnetic stainless steel SUS430 as in FIG. 12. FIG. 13 shows the following. When the thickness of the non-magnetic stainless steel SUS304 is 300 μm or less, the total amount of heat generated is larger than 1.0. In particular, in the range where the thickness of the non-magnetic stainless steel SUS304 is from 90 μm to 257 μm, the total amount of heat generated is close to its peak value. That is, as examined in connection with copper above, it is possible to obtain 10% higher heating efficiency than when the fixing roller 211 and the pressure belt 221 are formed with a magnetic metal alone. In view of this, in the fixing apparatus 201 of the sixth embodiment, the non-magnetic stainless steel SUS304 of which the non-magnetic-metal heating layer 213 of the fixing roller 211 is formed is given a thickness of 250 μm.

FIG. 14 is a table showing the relationship between the eddy current load and thickness of the non-magnetic-metal heating layer and the influence of the eddy current load on the amount of heat generated.

Here, the eddy current load is the value obtained by dividing the electrical resistivity of the material by the depth at which eddy currents are produced by electromagnetic induction, and is thus given as $R=\rho/z$ (where R represents the eddy current load, ρ represents the electrical resistivity, and z represents the depth at which eddy currents are produced). Normally, the depth z at which eddy currents are produced is equal to the magnetic filed permeation depth δ, and thus $z=\delta$. However, in a case where the thickness d of the metal layer used is smaller than the magnetic field permeation depth δ, $z=d$. Accordingly, the eddy current load R is $R=\rho/d$, and is thus determined by the electrical resistivity ρ and the thickness d of the metal layer. On the other hand, in a case where the eddy current load R is determined from the beginning, the thickness d of the metal layer can be derived from the eddy current load R and the electrical resistivity p.

The left-hand portion of the table of FIG. 14, including the columns put together under the heading "conditions of the non-magnetic-metal heating layer," shows the relationship between the eddy current load and the layer thickness with respect to copper and non-magnetic stainless steel SUS304. The right-hand portion of the table shows the amount of heat generated by each of the non-magnetic-metal and magnetic-metal heating layers 213 and 224 and the total amount of heat generated by them, assuming that the amount of heat generated by the magnetic-metal heating layer alone is 1. Here, the values shown as the amount of heat generated are those obtained by converting the readings in the graphs of FIGS. 12 and 13 described earlier into values. The conditions that yield high heating efficiency with the total amount of heat generated equal to or more than 1.0 are as follows. It is preferable that the eddy current load of the non-magnetic-metal heating layer 213 be $2.4\times10^{-3}\Omega$ or more, more preferably in the range from $2.8\times10^{-3}\Omega$ to $8.0\times10^{-3}\Omega$. With the eddy current load of the non-magnetic-metal heating layer 213 in this range, it is possible to obtain high heating efficiency even with a metal other than copper or non-magnetic stainless steel SUS304.

In a case where aluminum is used as the non-magnetic metal, since aluminum has an electrical resistivity of $2.66\times10^{-8}\ \Omega\cdot m$, by dividing this by the values of the eddy current load given above, it is found that a layer thickness of 11.0 μm or less yields high heating efficiency. A more preferred range is from 3.3 μm to 9.5 μm.

Figure 15:
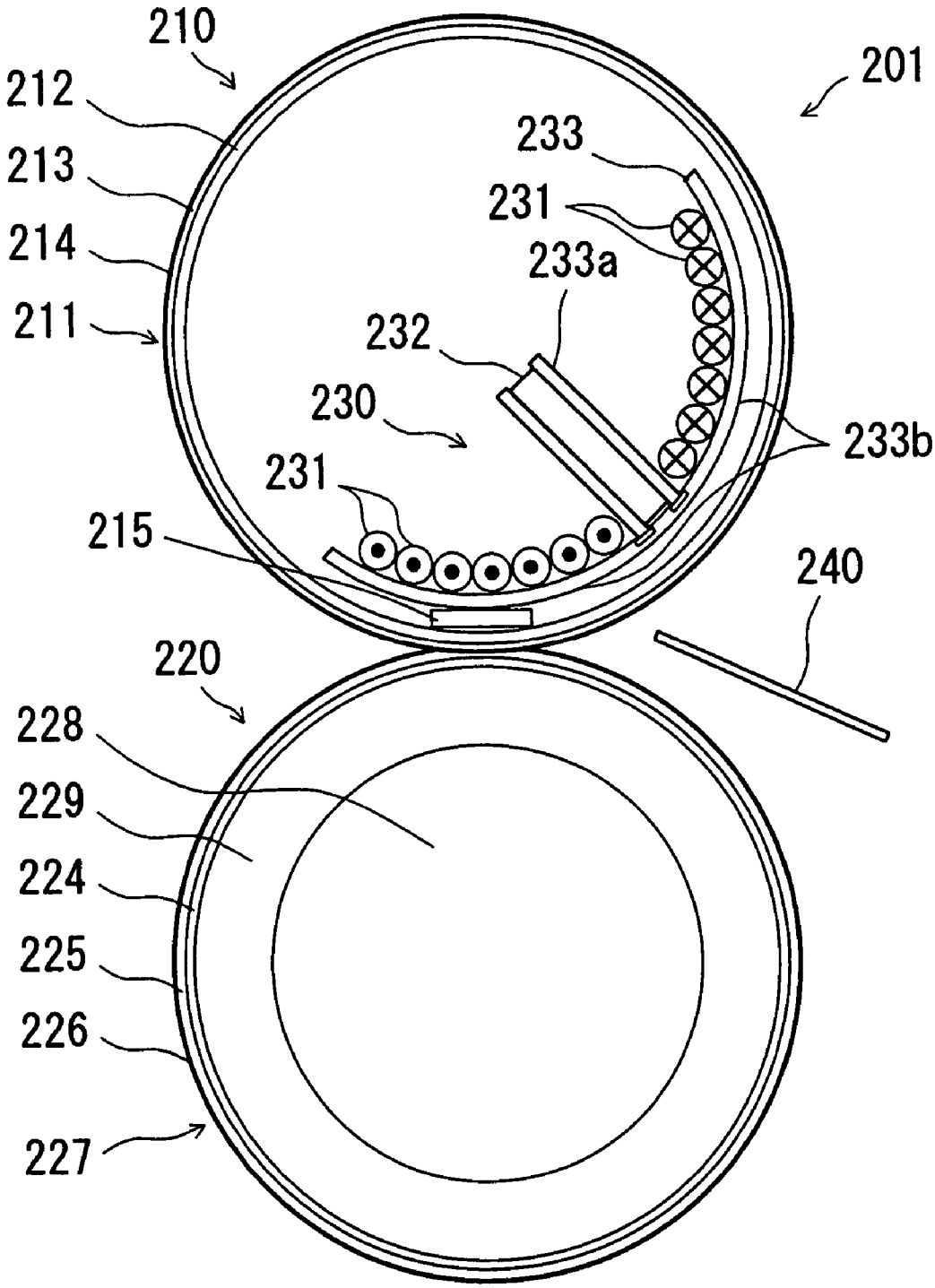
FIG. 15 is a schematic sectional view showing an outline of the construction of the fixing apparatus of a seventh embodiment of the invention.

Next, the construction of the fixing apparatus of a seventh embodiment of the invention will be described with reference to FIG. 15. FIG. 15 is a schematic sectional view showing an outline of the construction of the fixing apparatus of the seventh embodiment. The construction of the seventh embodiment is basically the same as that of the sixth embodiment, and therefore, in the following descriptions, such components as are found also in the sixth embodiment are identified with the same reference numerals, and their explanations will not be repeated.

The fixing apparatus 201 of the seventh embodiment is provided with a fixing section 210 and a pressure section 220. The fixing section 210 includes a fixing roller 211 functioning as a fixing member. Inside the fixing roller 211, there is disposed an electromagnetic induction section 230. At the place where paper is fed in, there is provided a paper feed guide 240. The pressure section 220 includes a pressure roller 227 functioning as a pressure member.

The pressure roller 227 is 40 mm across, and has a heat insulating layer 229 of silicone sponge laid on the surface of a core member 228 formed of heat-resistant synthetic resin or the like. Outside the heat insulating layer 229, there is laid a magnetic-metal heating layer 224. The magnetic-metal heating layer 224 is a 50 μm thick nickel plating layer. Outside the magnetic-metal heating layer 224, there is laid a 100 μm thick elastic layer 225 of silicone rubber. Outside the elastic layer 225, a 50 μm thick PFA tube is laid as a stick-free layer 226. Between the pressure roller 227 and the fixing roller 211, there is formed a nip through which paper is passed.

As in the sixth embodiment, the fixing and pressure sections 210 and 220 may be built with rollers for both of them, or with a roller for one of them and a belt for the other, or with belts for both of them.

By providing the heat insulating layer 229 inside the magnetic-metal heating layer 224 of the pressure roller 227 as described above, it is possible to reduce the heat capacity of the pressure roller 227. As a result, it is possible to further shorten the time required for the surface or the pressure roller 227 to reach the temperature suitable for fixing.

Figure 16:
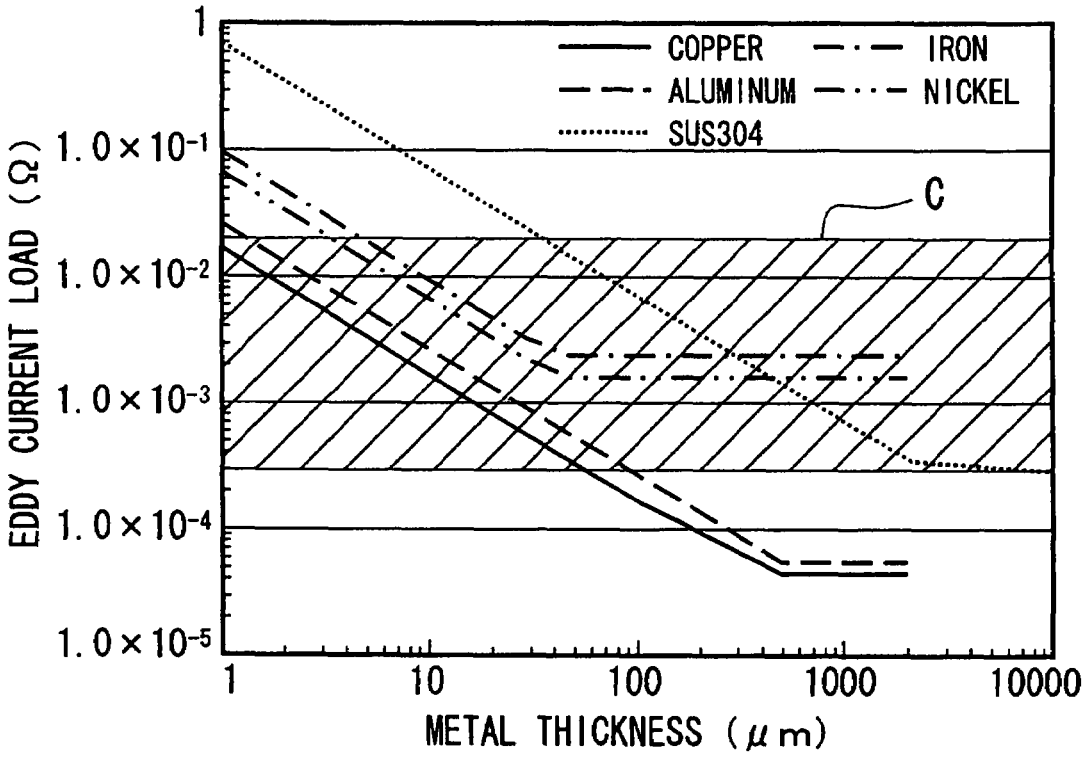
FIG. 16 is a graph showing the relationship between the metal thickness and the eddy current load.

Next, the thickness of the magnetic-metal heating layer of the pressure member will be described with reference to FIG. 16. FIG. 16 is a graph showing the relationship between the thickness of the metals of which the heating layers of the fixing and pressure members are formed and the eddy current load. Along the horizontal axis of the graph is taken the thickness of the metal, and along the horizontal axis is taken the eddy current load of the metal. Here, copper, aluminum, and non-magnetic stainless steel SUS304 are taken up as examples of non-magnetic metals, and iron and nickel are taken up as examples of magnetic metals.

In the figure, the area C indicates the range of the eddy current load within which a metal can be easily heated by induction heating. Specifically, when the eddy current load of the metals of which the heating layers of the fixing and pressure members are formed is in the range from $3.0\times10^{-4}\Omega$ to $2.0\times10^{-2}\Omega$, they can be heated easily by induction heating. For example, with nickel, which is a magnetic metal, when its eddy current load is $2.0\times10^{-2}\Omega$ or less, that is, when its thickness is 3.5 μm or more, it can be heated. With iron, when its thickness is 5.0 μm or more, it can be heated.

However, making the magnetic-metal heating layer, such as a nickel or iron layer, of the pressure member unnecessarily thick results in unnecessarily high rigidity, making it impossible to obtain elasticity for forming a suitable nip. For this reason, it is preferable that the magnetic-metal heating layer of the pressure member be given a thickness of 100 μm or less. In view of this, in the sixth and seventh embodiments, the nickel layer used as the magnetic-metal heating layer of the pressure member is given a thickness of 50 μm.

By determining the thickness of the magnetic-metal heating layer of the pressure member in this way, it is possible to obtain high heating efficiency. Moreover, the thickness so determined does not spoil the elasticity of the pressure member. This makes it possible to realize a fixing apparatus with high fixing performance.

When the non-magnetic metal is copper, aluminum, or non-magnetic stainless steel SUS304, as will be understood from FIGS. 12 to 14, it is preferable that its eddy current load be $2.4\times10^{-3}\Omega$ or more, more preferably in the range from $2.8\times10^{-3}\Omega$ to $8.0\times10^{-3}\Omega$.

Here, the magnetic field permeation depth of the magnetic-metal heating layer of the pressure member will be considered. If the thickness of the magnetic-metal heating layer of the pressure member is smaller than the magnetic field permeation depth, the magnetic flux produced by the exciting coil passes through the magnetic-metal heating layer, leaking to inside it. If there is another metal member inside the magnetic-metal heating layer of the pressure member, quite inconveniently, this metal member is heated unnecessarily, leading to a waste of heating energy.

To avoid this, the magnetic-metal heating layer of the pressure member needs to be given a thickness greater than the magnetic field permeation depth. As described earlier, the magnetic field permeation depth is given as $\delta=503\sqrt{(\rho/f\mu')}$ (where $\delta$ represents the magnetic field permeation depth, $\rho$ represents the electrical resistivity, f represents the frequency, and $\mu'$ represents the relative magnetic permeability). In a case where nickel is used to form the magnetic-metal heating layer, if the frequency f is assumed to be 30 kHz, since nickel has an electrical resistivity $\rho$ of $6.80\times10^{-8}\Omega\cdot$m and a relative magnetic permeability $\mu'$ of 300, the magnetic field permeation depth $\delta$ is 43.7 μm. Likewise, in a case where iron is used, if the frequency f is assumed to be 30 kHz, since iron has an electrical resistivity $\rho$ of $9.71\times10^{-8}\ \Omega\cdot$m and a relative magnetic permeability $\mu'$ of 500, the magnetic field permeation depth $\delta$ is 40.5 μm.

From the foregoing, it is clear that nickel requires a thickness of 43.7 μm or more and iron requires a thickness of 40.5 μm or more. However, as described above, to obtain elasticity for forming a suitable nip, it is preferable to limit the thickness of the magnetic-metal heating layer of the pressure member to 100 μm or less.

In this way, by limiting the thickness of the nickel layer used as the magnetic-metal heating layer of the pressure member within the range from 43.7 μm to 100 μm and the thickness of the iron layer so used within the range from 40.5 μm to 100 μm, it is possible to obtain high heating efficiency and in addition prevent leakage of a magnetic flux to inside the magnetic-metal heating layer. As a result, it is possible to realize a fixing apparatus that operates with a reduced waste of heating energy and thus with high heating efficiency. The thickness determined as described above does not spoil the elasticity of the pressure member, and thus helps obtain enhanced fixing performance.

Figure 17:
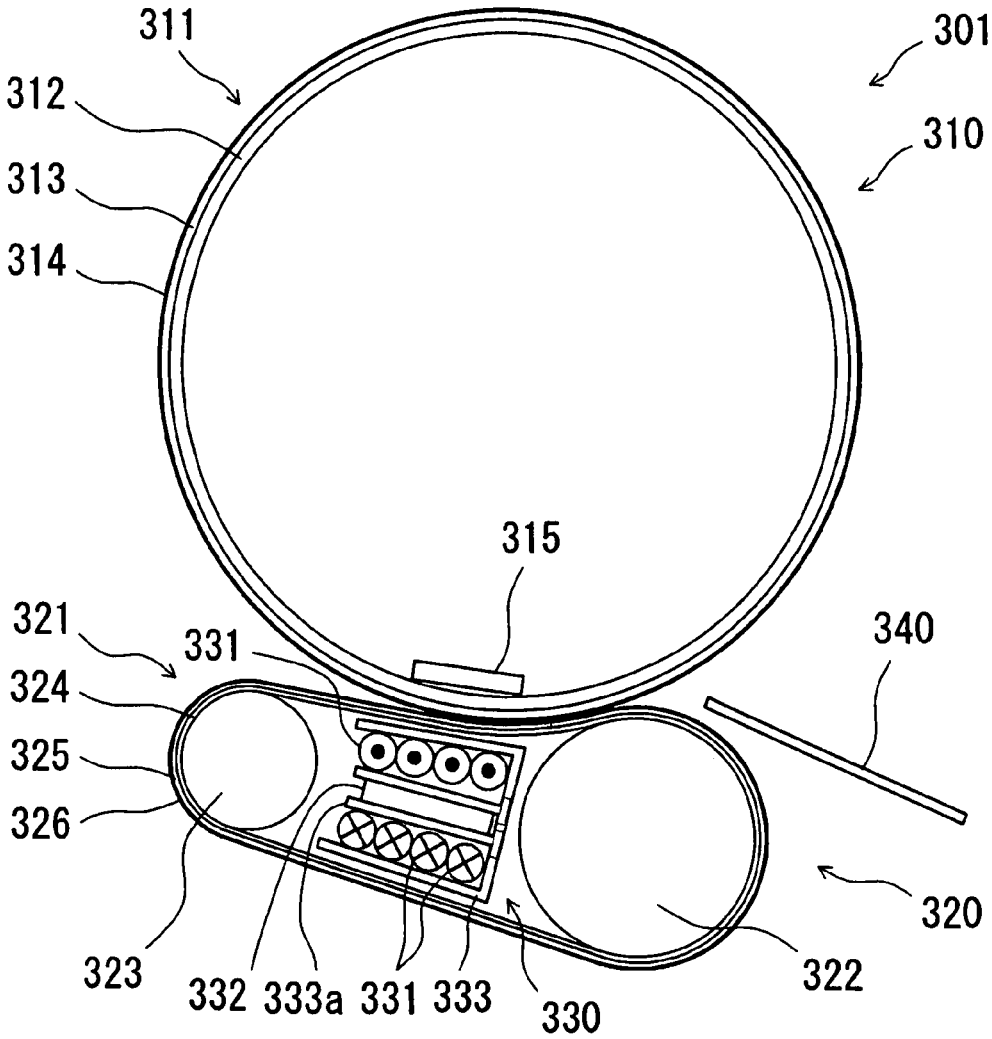
FIG. 17 is a schematic sectional view showing an outline of the construction of the fixing apparatus of an eighth embodiment of the invention.
Figure 18:
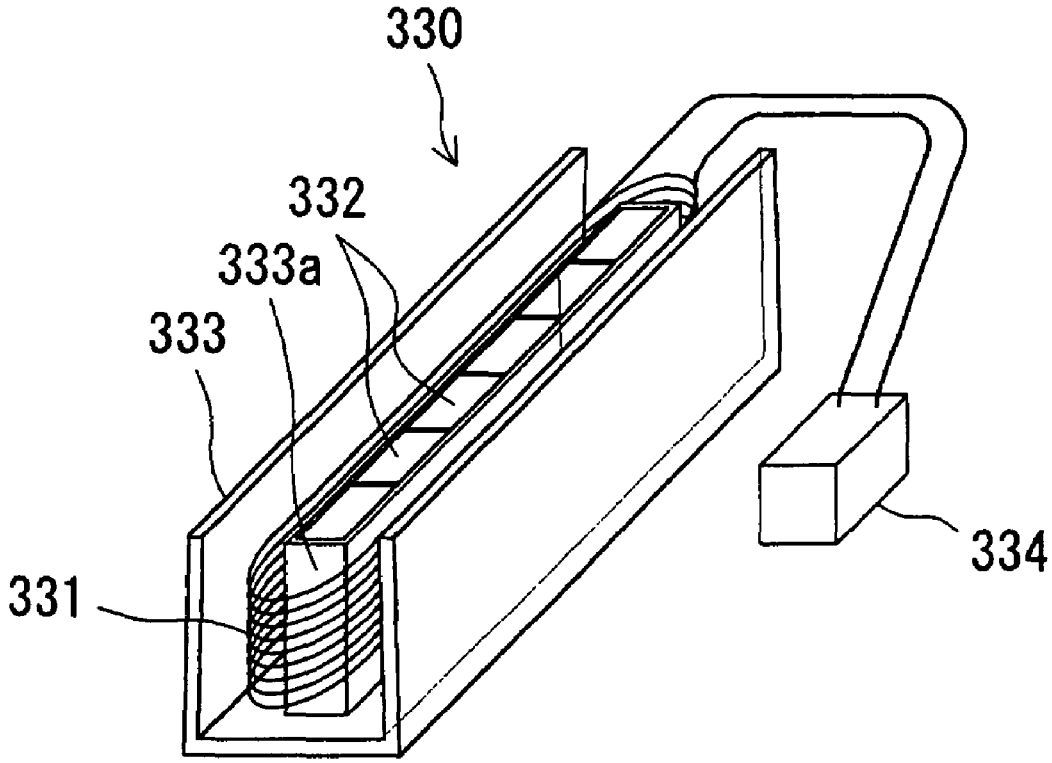
FIG. 18 is a perspective view of the exciting coil portion of the fixing apparatus of the eighth embodiment.

Next, the construction of the fixing apparatus of an eighth embodiment of the invention will be described with reference to FIGS. 17 and 18. FIG. 17 is a schematic sectional view showing an outline of the configuration of the fixing apparatus of the eighth embodiment, and FIG. 18 is a perspective view of the exciting coil portion.

The fixing apparatus 301 of the eighth embodiment is provided with a fixing section 310 and a pressure section 320. The pressure section 320 includes a pressure belt 321 functioning as a pressure member. Inside the pressure belt 321, there is provided an electromagnetic induction portion 330. At the place where paper is fed in, there is provided a paper feed guide 340.

The fixing section 310 includes a fixing roller 311 functioning as a fixing member. The fixing roller 311 is 40 mm across, and has a magnetic-metal heating layer 313 laid outside a core member 312 formed of heat-resistant synthetic resin or the like. The core member 312 may be a metal tube such as an iron tube. The magnetic-metal heating layer 313 is formed by plating nickel or the like. Outside the magnetic-metal heating layer 313, there is laid a 20 μm thick stick-free layer 314 to make it difficult for toner to attach to the fixing roller 311. The stick-free layer 314 is made of fluorocarbon resin such as PFA (tetrafluoroethylene/per fluoro alkyl vinyl ether copolymer), and is formed by spray coating or by tube laying. There may be additionally laid an elastic layer formed of silicone rubber immediately inside the stick-free layer 314.

The pressure section 320 is composed of a pressure belt 321 functioning as a pressure member, a main roller 322, and a sub roller 323. The pressure belt 321, which makes contact with the fixing roller 311, has a non-magnetic-metal heating layer 324 formed on a polyimide film (not illustrated). The non-magnetic-metal heating layer 324 is a 50 μm thick layer formed by plating non-magnetic stainless steel SUS304. Outside the non-magnetic-metal heating layer 324, there is laid an elastic layer 325. The elastic layer 325 is a 100 μm thick silicone rubber layer. Outside the elastic layer 325, there is laid a stick-free layer 326. The stick-free layer 326 is formed by laying a 50 μm thick PFA tube.

The pressure belt 321 is put around the main roller 322 and the sub roller 323, and is given a predetermined tension. The pressure belt 321 makes contact with the fixing roller 311 so as to form a nip through which paper is passed.

The construction of the fixing and pressure sections 310 and 320 may be reversed so that the fixing section 310 is built with a belt and the pressure section 320 with a roller. Alternatively, both the fixing and pressure sections 310 and 320 may be built with either rollers or belts. In any case, an exciting coil 331, which will be described below, is disposed inside the pressure member, near the portion thereof where the fixing and pressure members make contact with each other. In a case where the fixing roller 311 is replaced with a belt, a non-magnetic-metal heating layer is laid on a polyimide film by plating or by rolling, and a coating of fluorocarbon resin such as PFA is laid further outside.

The electromagnetic induction section 330 is composed of an exciting coil 331, a ferrite core 332, and a support member 333. The exciting coil 331 is formed by winding a litz wire, composed of 300 twisted enamel wires each 0.1 mm across, in the direction along the axis of the main roller 322. Inside the exciting coil 331 so wound is disposed the ferrite core 332 for intensifying the magnetic field. The support member 333 is molded of heat-resistant synthetic resin, and is provided with a ferrite core housing portion 333*a*. The exciting coil 331 is so wound as to surround the ferrite core housing portion 333*a*. To the exciting coil 331 is connected a high-frequency electric power source 334 operating with a rated output of 1 500 W at a frequency of 20 to 50 kHz. The ferrite core 332 may be replaced with a member formed of any other material than ferrite, provided that it has high magnetic permeability.

The electromagnetic induction section 330 is disposed inside the pressure belt 321 with the exciting coil 331 located near the place where the fixing roller 311 and the pressure roller 321 make contact with each other so that a magnetic flux passes through that place.

Inside the fixing roller 311, near the place where the fixing roller 311 and the pressure roller 321 make contact with each other, there is disposed a thermistor 315. This thermistor 315 measures the temperature of the heating portion so that the temperature is controlled by controlling the output of the high-frequency electric power source 334.

Figure 19:
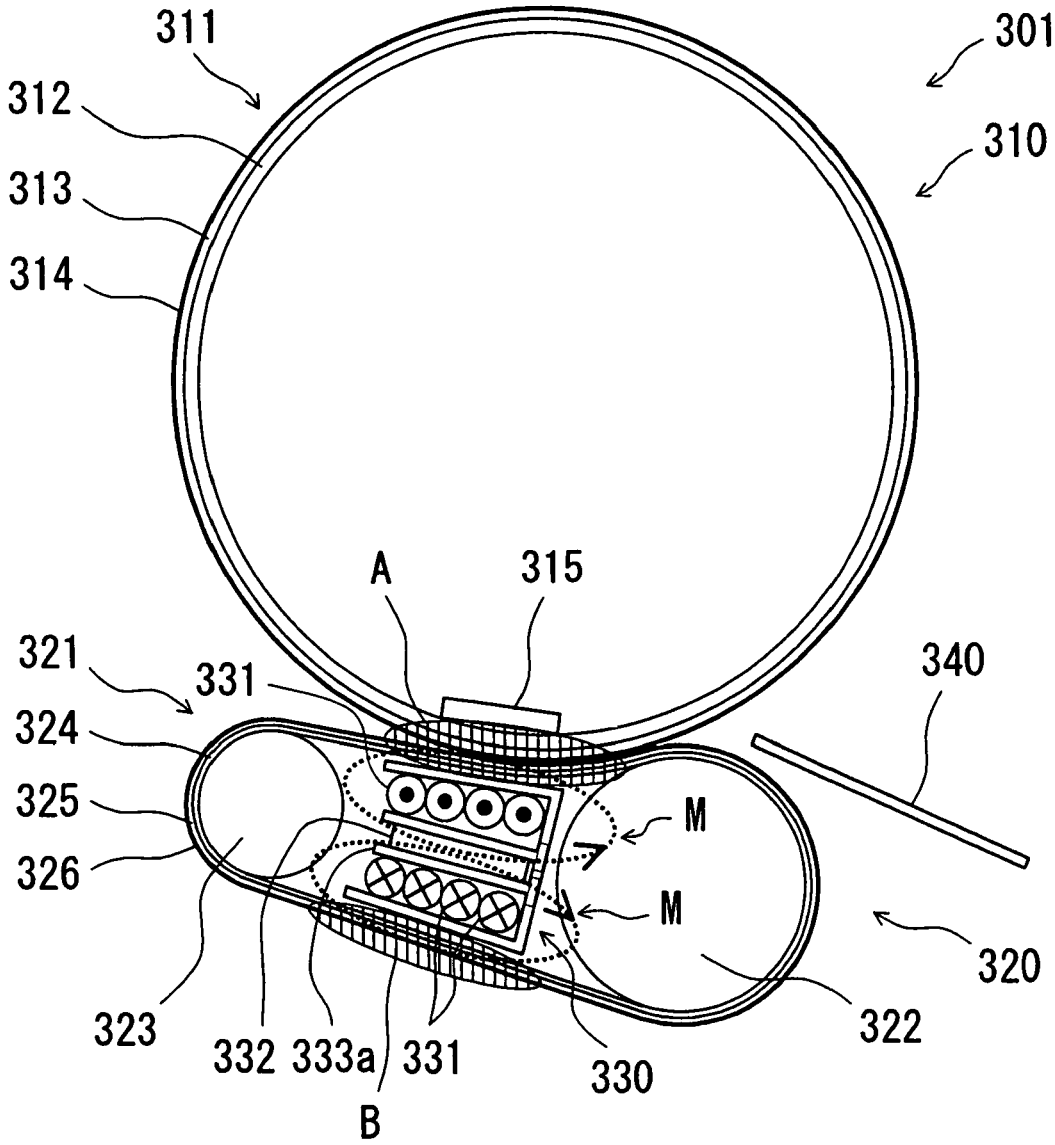
FIG. 19 is a schematic sectional view showing how the fixing apparatus of the eighth embodiment achieves heating.

FIG. 19 is a schematic sectional view showing how the fixing apparatus of the eighth embodiment achieves heating. The fixing apparatus 301 achieves heating in the following manner.

When a high-frequency electric current is passed through the exciting coil 331, a magnetic field is produced. Most of the magnetic flux M of the produced magnetic field passes through the ferrite core 332, which is a high magnetic permeability member, with the result that the magnetic field is intensified. When the produced magnetic flux M passes through the non-magnetic-metal heating layer 324 of the pressure belt 321 and the magnetic-metal heating layer 313 of the fixing roller 311, eddy currents flow in portions A and B of the metals where the magnetic flux M passes, and the electric resistance of the metals produces Joule's heat there. In particular in the portion A, the presence of the magnetic-metal heating layer 313 causes more intense concentration of the magnetic field and thus produces more heat than in the portion B. The magnetic flux M passes through the non-magnetic-metal heating layer 324 of the pressure belt 321 and reaches the magnetic-metal heating layer 313 of the fixing roller 311. Thus, heat is generated in both the members.

In this way, not only the fixing roller 311 but also the pressure belt 321 can be heated directly. Accordingly, paper passing through the nip receives heat from both sides thereof. This makes it possible to set the temperature of the fixing roller 311 lower. This eliminates the need to feed extra heat, and thus helps obtain high heating efficiency.

Moreover, the pressure belt 321 can be heated even while paper is being passed. Accordingly, even when a sheet of paper that is elongate in the direction in which it is passed is passed, it is possible to reduce the drop in temperature at the rear end of the sheet and thereby obtain stable fixability.

Now, the influence of the thickness of the non-magnetic-metal heating layer of the pressure belt 321 and the thickness of the magnetic-metal heating layer of the fixing roller 311 on the amount of heat generated will be examined with reference again to FIGS. 12, 13, 14, and 16, which were referred to in connection with the sixth embodiment.

First, a case where the non-magnetic-metal heating layer of the pressure belt 321 is formed of copper will be examined with reference to FIG. 12. To enhance the fixability of toner, the temperature of the surface of the fixing roller 311, with which toner makes direct contact, should better be higher than the surface temperature of the pressure belt 321. FIG. 12 shows that this requirement is fulfilled when the amount of heat generated by the magnetic-metal heating layer 313 is larger than the amount of heat generated by the copper of which the non-magnetic-metal heating layer 324 is formed, that is, when the copper layer is 2.9 μm or less thick. Moreover, under these conditions, the total amount of heat generated is larger than 1.0. That is, it is possible to obtain higher heating efficiency when the fixing roller 311 and the pressure belt 321 are formed with a non-magnetic metal and a magnetic metal combined together than when they are formed with a magnetic metal alone. By giving the copper a thickness of 2.9 μm or less, it is possible to obtain 10% higher heating efficiency at the maximum.

Next, a case where the non-magnetic-metal heating layer of the pressure belt 321 is formed of non-magnetic stainless steel SUS304 will be examined with reference to FIG. 13. FIG. 13 shows that, when the layer of non-magnetic stainless steel SUS304 is 125 μm or less thick, the amount of heat generated by the magnetic-metal heating layer is larger than that generated by the non-magnetic-metal heating layer, and the total amount of heat generated is larger than 1.0. That is, as explained in connection with copper above, it is possible to obtain 10% higher heating efficiency at the maximum than when the fixing roller 311 and the pressure belt 321 are formed with a magnetic metal alone. In view of this, in the fixing apparatus 301 of the eighth embodiment, the non-magnetic stainless steel SUS304 of which the non-magnetic-metal heating layer 324 of the pressure belt 321 is formed is given a thickness of 50 μm.

FIG. 14 shows that the conditions under which the amount of heat generated by the magnetic-metal heating layer is larger than that generated by the non-magnetic-metal heating layer are fulfilled when the eddy current load of the non-magnetic-metal heating layer is $5.7\times10^{-3}\Omega$ or more. With the eddy current load of the non-magnetic-metal heating layer equal to or more than this value, it is possible to obtain high heating efficiency even with a metal other than copper or non-magnetic stainless steel SUS304.

In a case where aluminum is used as the non-magnetic metal, since aluminum has an electrical resistivity of $2.66\times10^{-8}\ \Omega\cdot m$, by dividing this by the value of the eddy current load given above, it is found that a layer thickness of 4.6 μm or less yields high heating efficiency.

Figure 20:
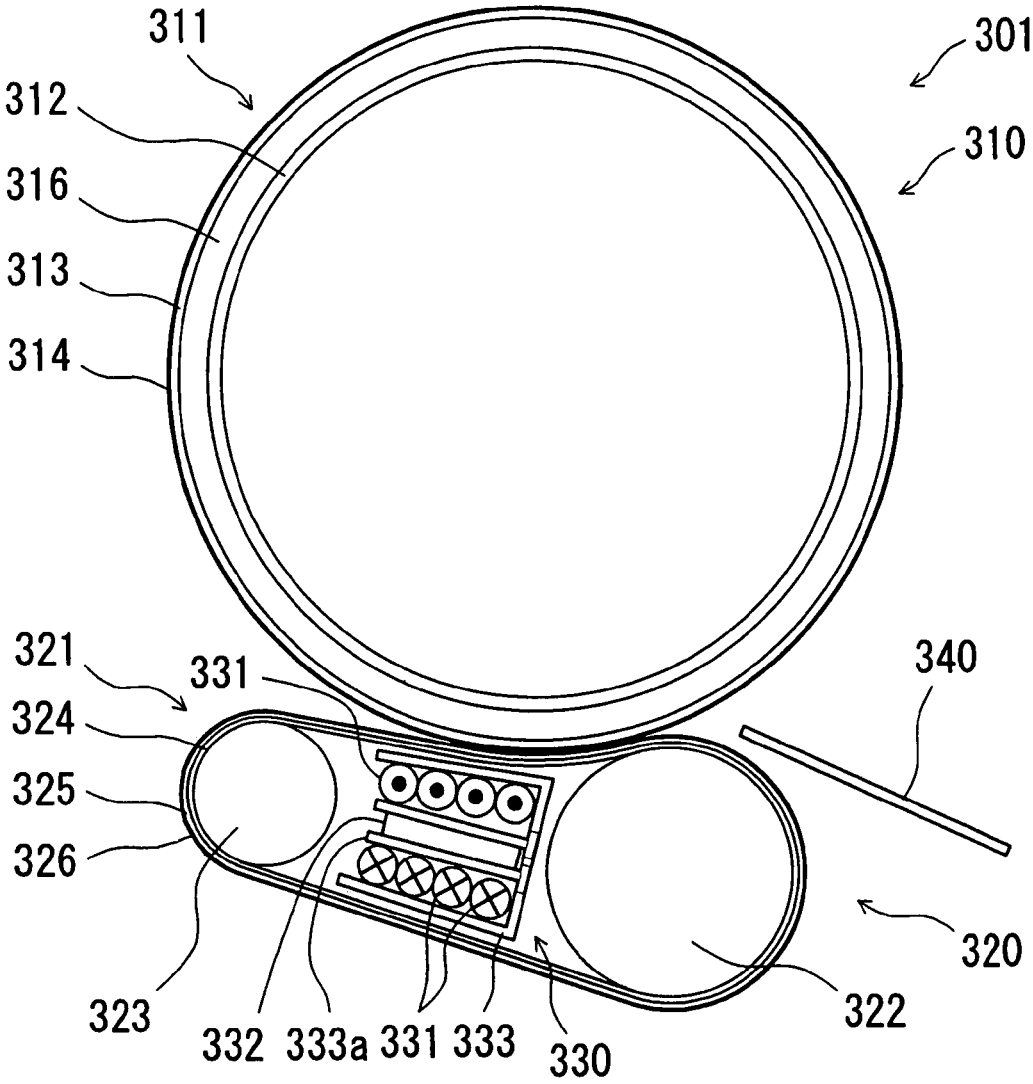
FIG. 20 is a schematic sectional view showing an outline of the construction of the fixing apparatus of a ninth embodiment of the invention.

Next, the construction of the fixing apparatus of a ninth embodiment of the invention will be described with reference to FIG. 20. FIG. 20 is a schematic sectional view showing an outline of the construction of the fixing apparatus of the ninth embodiment. The construction of the ninth embodiment is basically the same as that of the eighth embodiment, and therefore, in the following descriptions, such components as are found also in the eighth embodiment are identified with the same reference numerals, and their explanations will not be repeated.

The fixing apparatus 301 of the ninth embodiment is provided with a fixing section 310 and a pressure section 320. The pressure section 320 includes a pressure belt 321 functioning as a pressure member. Inside the pressure belt 321, there is disposed an electromagnetic induction section 330. At the place where paper is fed in, there is provided a paper feed guide 340. The fixing section 310 includes a fixing roller 311 functioning as a fixing member.

The fixing roller 311 is 40 mm across, and has a heat insulating layer 316 of silicone sponge laid on the surface of a core member 312 formed of heat-resistant synthetic resin or the like. Outside the heat insulating layer 316, there is laid a magnetic-metal heating layer 313. The magnetic-metal heating layer 313 is a 50 μm thick nickel plating layer. Outside the magnetic-metal heating layer 313, there is laid a 20 μm thick stick-free layer 314 of PFA to prevent toner from attaching to the fixing roller 311. There may be additionally laid an elastic layer of silicone rubber immediately inside the stick-free layer 314.

As in the eighth embodiment, the fixing and pressure sections 310 and 320 may be built with rollers for both of them, or with a roller for one of them and a belt for the other, or with belts for both of them.

By providing the heat insulating layer 316 inside the magnetic-metal heating layer 313 of the fixing roller 311 as described above, it is possible to reduce the heat capacity of the fixing roller 311. As a result, it is possible to further shorten the time required for the surface or the fixing roller 311 to reach the temperature suitable for fixing.

Next, the thickness of the magnetic-metal heating layer of the fixing member will be described with reference to FIG. 16. In FIG. 16, the area C indicates the range of the eddy current load within which a metal can be easily heated by induction heating. Specifically, when the eddy current load of the metals of which the heating layers of the fixing and pressure members are formed is in the range from $3.0\times10^{-4}\Omega$ to $2.0\times10^{-2}\Omega$, they can be heated easily by induction heating. For example, with nickel, which is a magnetic metal, when its eddy current load is $2.0\times10^{-2}\Omega$ or less, that is, when its thickness is 3.5 μm or more, it can be heated. With iron, when its thickness is 5.0 μm or more, it can be heated. By determining the thickness of the magnetic-metal heating layer of the fixing member so as to fulfill this condition, it is possible to enhance the heating efficiency of the fixing apparatus 301.

When the non-magnetic metal is copper, aluminum, or non-magnetic stainless steel SUS304, as will be understood from FIGS. 12 to 14, it is preferable that its eddy current load be $2.4\times10^{-3}\Omega$ or more, more preferably in the range from $2.8\times10^{-3}\Omega$ to $8.0\times10^{-3}\Omega$.

The thickness of the magnetic-metal heating layer needs to be considered also from the perspective of the magnetic field permeation depth. As examined in connection with the sixth embodiment, by giving the magnetic-metal heating layer a thickness of 43.7 μm or more when it is formed of nickel and 40.5 μm or more when it is formed of iron, it is possible to simultaneously achieve high heating efficiency and prevention of leakage of a magnetic flux.

Figure 21:
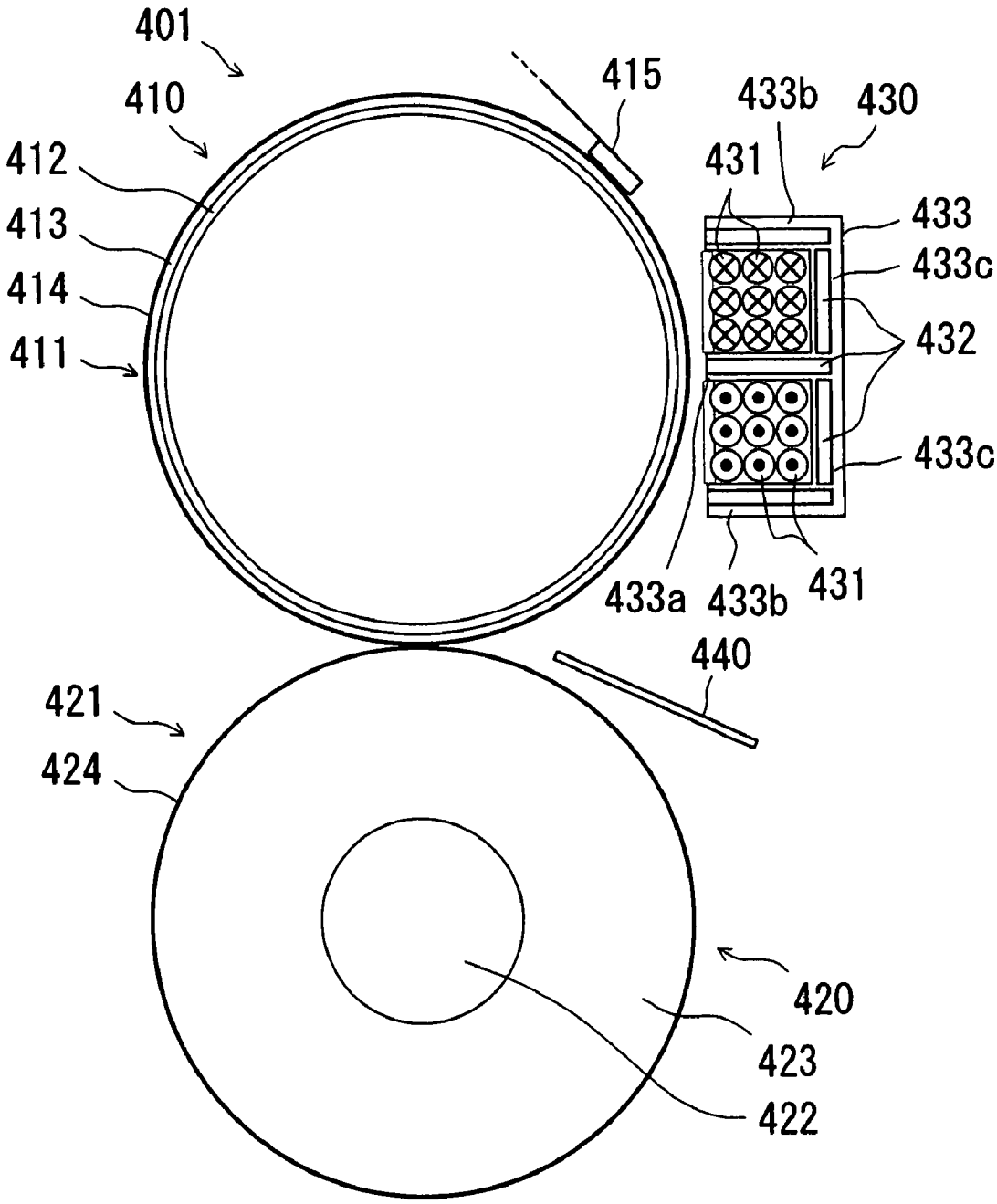
FIG. 21 is a schematic sectional view showing an outline of the construction of the fixing apparatus of a tenth embodiment of the invention.

Next, the construction of the fixing apparatus of a tenth embodiment of the invention will be described with reference to FIG. 21. FIG. 21 is a schematic sectional view showing an outline of the configuration of the fixing apparatus of the tenth embodiment.

The fixing apparatus 401 of the tenth embodiment is provided with a fixing section 410 and a pressure section 420. The fixing section 410 includes a: fixing roller 411 functioning as a fixing member. Inside the fixing roller 411, there is disposed an electromagnetic induction section 430. At the place where paper is fed in, there is provided a paper feed guide 440.

The fixing roller 411 is 40 mm across, and has a magnetic-metal heating layer 412 formed of a 250 μm thick iron pipe (the type of steel pipe identified as STKM in the Japanese Industrial Standards). On the outer surface of the magnetic-metal heating layer 412, there is laid a non-magnetic-metal heating layer 413 in intimate contact therewith. In a case where the non-magnetic-metal heating layer 413 is formed of non-magnetic stainless steel SUS304, it can be formed by first forming a 250 μm thick tube of non-magnetic stainless steel SUS304 and then combining it with the magnetic-metal heating layer 412 by shrink fitting.

Outside the non-magnetic-metal heating layer 413, there is laid a 20 μm thick stick-free layer 414 to make it difficult for toner to attach to the fixing roller 411. The stick-free layer 414 is made of fluorocarbon resin such as PFA (tetrafluoroethylene/per fluoro alkyl vinyl ether copolymer), and is formed by spray coating or by tube laying. There may be additionally laid an elastic layer formed of silicone rubber immediately inside the stick-free layer 414.

The pressure section 420 includes a pressure roller 421 functioning as a pressure member. The pressure roller 421 is 40 mm across, and has an elastic layer 423 of sponge-like silicone rubber laid on the surface of a core metal 422. Outside the elastic layer 423, there is laid a 50 μm thick PFA tube to form a stick-free layer 424. Between the pressure roller 421 and the fixing roller 411, there is formed a nip through which paper is passed.

The fixing and pressure sections 410 and 420 may be built with rollers for both of them, or with a roller for one of them and a belt for the other, or with belts for both of them. In any case, the fixing member is composed of, from the outside, the stick-free layer 414, non-magnetic-metal heating layer 413, and magnetic-metal heating layer 412, and an exciting coil 431, which will be described below, is disposed outside the fixing member.

The electromagnetic induction section 430 is composed of an exciting coil 431, a ferrite core 432, and a support member 433. The exciting coil 431 is formed by winding a litz wire, composed of 300 twisted enamel wires each 0.1 mm across, in the direction along the axis of the fixing roller 411. Inside the exciting coil 431 so wound is disposed the ferrite core 432 for intensifying the magnetic field. The support member 433 is formed of heat-resistant synthetic resin, and is provided with ferrite core housing portions 433*a*, 433*b*, and 433*c*. The exciting coil 431 is so wound as to surround the ferrite core housing portion 433*a*.

The litz wires, of which the exciting coil 431 is formed, may be so wound as to run along the circumference of the fixing roller 411. The ferrite core 432 may be replaced with a member formed of any other material than ferrite, provided that it has high magnetic permeability The electromagnetic induction section 430 is disposed outside the fixing roller 411, at a distance therefrom and in a position near the place where the fixing and pressure rollers 411 and 421 make contact with each other.

Outside the fixing roller 411, near the exciting coil 431, there is disposed a thermistor 415. This thermistor 415 measures the temperature of the heating portion so that the temperature is controlled by controlling the output of the high-frequency electric power source.

Figure 22:
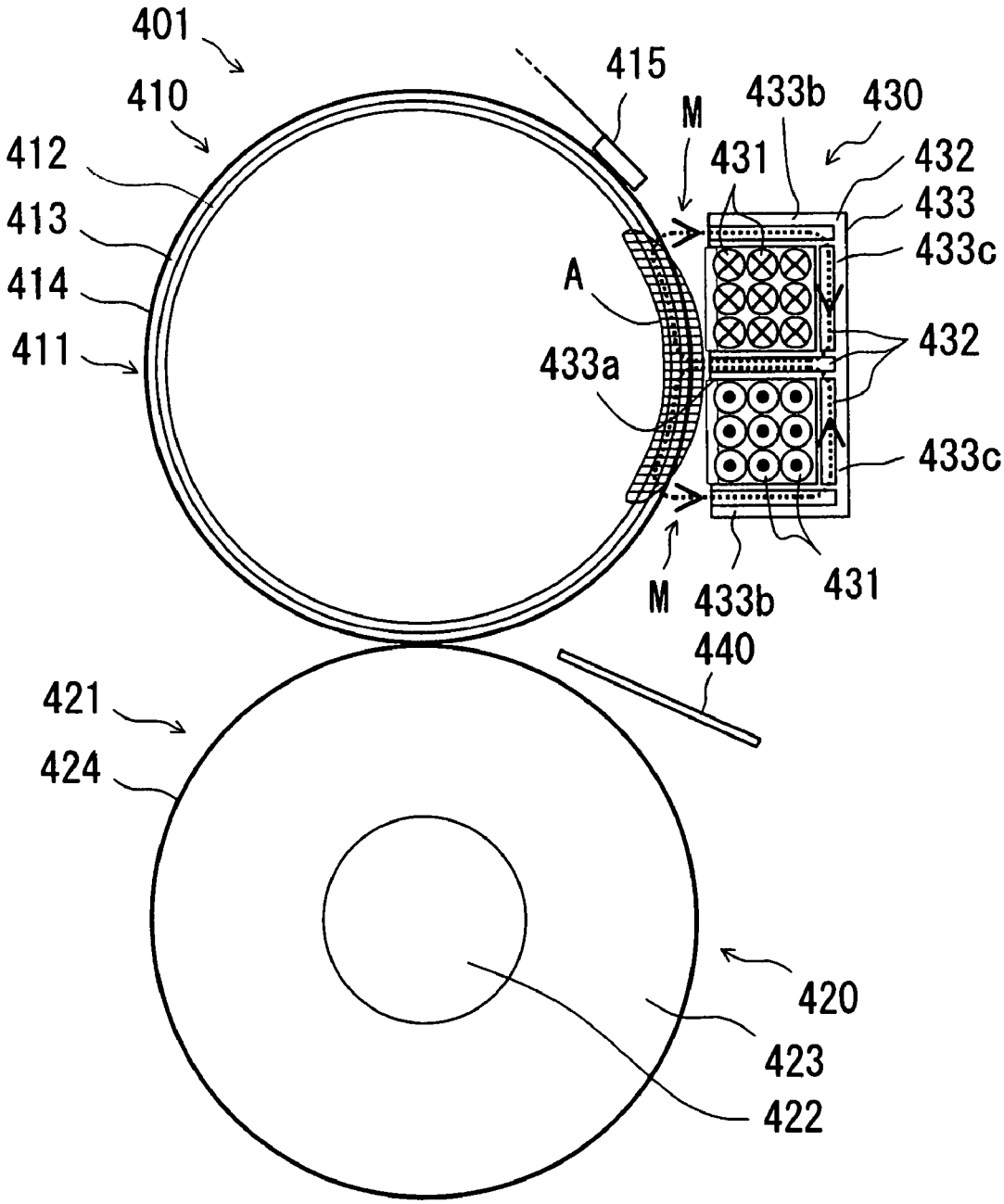
FIG. 22 is a schematic sectional view showing how the fixing apparatus of the tenth embodiment achieves heating.

FIG. 22 is a schematic sectional view showing how the fixing apparatus of the tenth embodiment achieves heating. The fixing apparatus 401 achieves heating in the following manner.

When a high-frequency electric current is passed through the exciting coil 431, a magnetic field is produced. Most of the magnetic flux M of the produced magnetic field passes through the ferrite core 432, which is a high magnetic permeability member, with the result that the magnetic field is intensified. When the produced magnetic flux M passes through the magnetic-metal and non-magnetic-metal heating layers 412 and 413 of the fixing roller 411, eddy currents flow in a portion A of the metal where the magnetic flux M passes, and the electric resistance of the metal produces Joule's heat there.

In this way, the magnetic-metal and non-magnetic-metal heating layers 412 and 413 of the fixing roller 411 are made to generate heat simultaneously by the shared exciting coil 431. This makes it possible to obtain high heating efficiency.

Moreover, the electromagnetic induction section 430 is disposed outside the fixing roller 411. This helps prevent the ferrite core 432 from being adversely affected by the heat generated by the fixing roller 411. It is also easy to achieve forced cooling by the use of a fan. As a result, it is possible to prevent deterioration of the performance of the ferrite core 432 and thereby obtain high heating efficiency.

Now, the influence of the thickness of the non-magnetic-metal heating layer 413 of the fixing roller 411 on the amount of heat generated will be examined with reference again to FIGS. 12, 13, 14, and 16, which were referred to in connection with the sixth embodiment.

In a case where, in the fixing roller 411, the non-magnetic-metal heating layer 413 is formed of copper and the magnetic-metal heating layer 412 is formed of non-magnetic stainless steel SUS430, as concluded in the similar examination made in connection with the sixth embodiment, when the copper layer is 7.0 μm or less thick, the total amount heat generated is larger than 1.0. In particular, in the range where the thickness of the copper is from 2.0 μm to 6.0 μm, the total amount of heat generated is close to its peak value. That is, it is possible to obtain higher heating efficiency when the fixing roller 411 is formed with a non-magnetic metal and a magnetic metal combined together than when is formed with a magnetic metal alone. By giving the copper a thickness in this range, it is possible to obtain 10% higher heating efficiency.

Next, a case where the non-magnetic-metal heating layer 413 of the fixing roller 411 is formed of non-magnetic stainless steel SUS304 will be examined with reference to FIG. 13. Here, the magnetic-metal heating layer 412 is assumed to be formed of magnetic stainless steel SUS430. FIG. 13 shows that, when the layer of non-magnetic stainless steel SUS304 is 300 μm or less thick, the total amount of heat generated is larger than 1.0. In particular, in the range where the thickness of the non-magnetic stainless steel SUS304 is from 90 μm to 257 μm, the total amount of heat generated is close to its peak value. That is, as examined in connection with copper above, it is possible to obtain 10% higher heating efficiency than when the fixing roller 411 is formed with a magnetic metal alone. In view of this, in the fixing apparatus 401 of the tenth embodiment, the non-magnetic stainless steel SUS304 of which the non-magnetic-metal heating layer 413 of the fixing roller 411 is formed is given a thickness of 250 μm.

FIG. 14 shows that, as in the sixth embodiment, the conditions under which the total amount of heat generated is larger than 1.0 are fulfilled when the eddy current load of the non-magnetic-metal heating layer 413 is $2.4\times10^{-3}\Omega$ or more, in particular in the range from $2.8\times10^{-3}\Omega$ to $8.0\times10^{-3}\Omega$. With the eddy current load of the non-magnetic-metal heating layer 413 within this range, it is possible to obtain high heating efficiency even with a metal other than copper or non-magnetic stainless steel SUS304.

In a case where aluminum is used as the non-magnetic metal, since aluminum has an electrical resistivity of $2.66\times10^{-8}\ \Omega\cdot m$, by dividing this by the values of the eddy current load given above, it is found that a layer thickness of 11.0 μm or less yields high heating efficiency. A more preferred range is from 3.3 μm to 9.5 μm.

Figure 23:
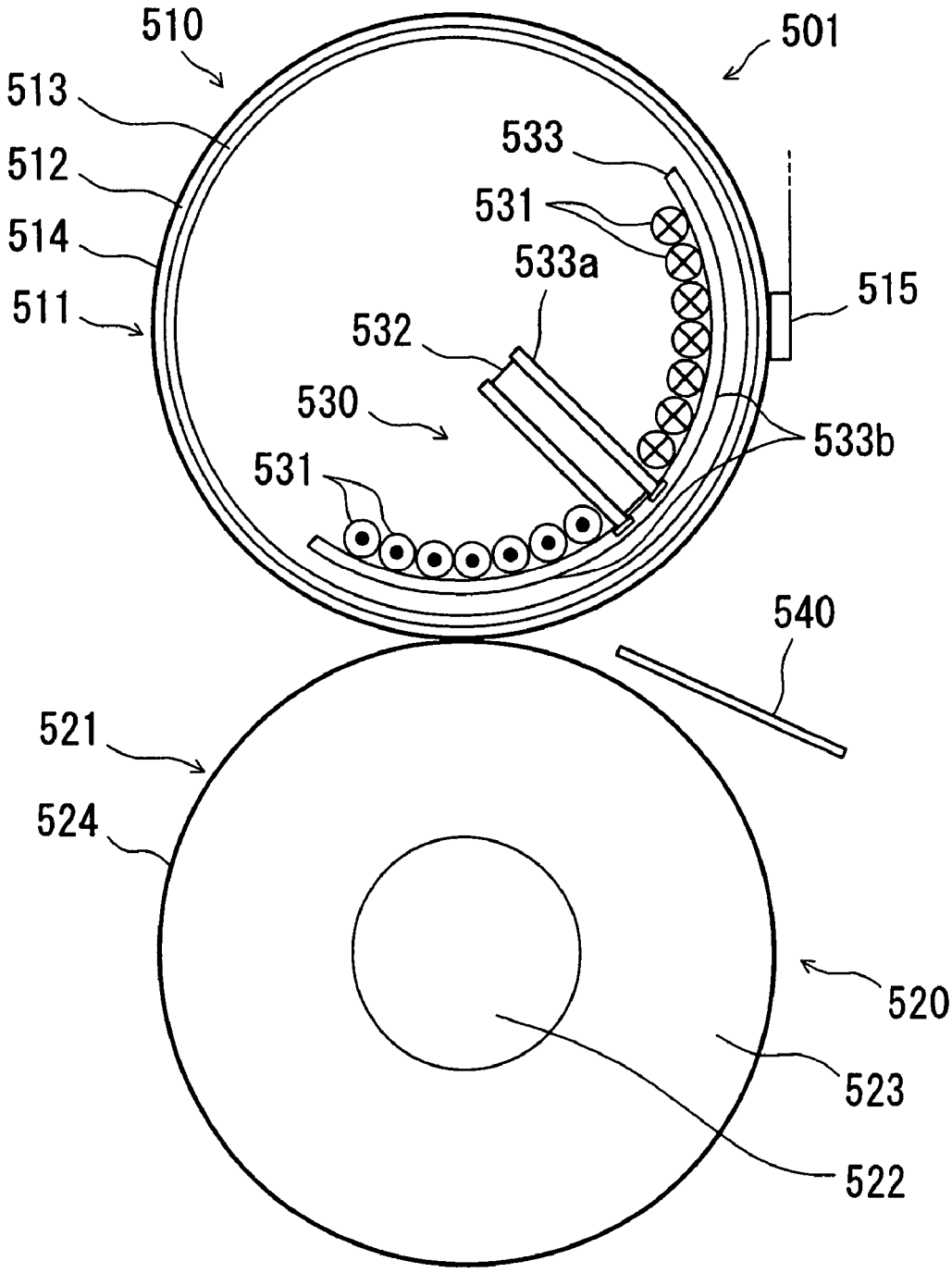
FIG. 23 is a schematic sectional view showing an outline of the construction of the fixing apparatus of an eleventh embodiment of the invention.

Next, the construction of the fixing apparatus of an eleventh embodiment of the invention will be described with reference to FIG. 23. FIG. 23 is a schematic sectional view showing an outline of the configuration of the fixing apparatus of the eleventh embodiment;

The fixing apparatus 501 of the eleventh embodiment is provided with a fixing section 510 and a pressure section 520. The fixing section 510 includes a fixing roller 511 functioning as a fixing member. Inside the fixing roller 511, there is disposed an electromagnetic induction section 530. At the place where paper is fed in, there is provided a paper feed guide 540.

The fixing roller 511 is 40 mm across, and has a magnetic-metal heating layer 512 formed of a 250 μm thick iron pipe (the type of steel pipe identified as STKM in the Japanese Industrial Standards). On the inner surface of the magnetic-metal heating layer 512, there is laid a non-magnetic-metal heating layer 513 in intimate contact therewith. In a case where the non-magnetic-metal heating layer 513 is formed of non-magnetic stainless steel SUS304, it can be formed by first forming a 250 μm thick tube of non-magnetic stainless steel SUS304 and then combining it with the magnetic-metal heating layer 512 by shrink fitting.

Outside the magnetic-metal heating layer 512, there is laid a 20 μm thick stick-free layer 514 to make it difficult for toner to attach to the fixing roller 511. The stick-free layer 514 is made of fluorocarbon resin such as PFA (tetrafluoroethylene/per fluoro alkyl vinyl ether copolymer), and is formed by spray coating or by tube laying. There may be additionally laid an elastic layer formed of silicone rubber immediately inside the stick-free layer 514.

The pressure section 520 includes a pressure roller 521 functioning as a pressure member. The pressure roller 521 is 40 mm across, and has an elastic layer 523 of sponge-like silicone rubber laid on the surface of a core metal 522. Outside the elastic layer 523, there is laid a 50 μm thick PFA tube to form a stick-free layer 524. Between the pressure roller 521 and the fixing roller 511, there is formed a nip through which paper is passed.

The fixing and pressure sections 510 and 520 may be built with rollers for both of them, or with a roller for one of them and a belt for the other, or with belts for both of them. In any case, the fixing member is composed of, from the outside, the stick-free layer 514, magnetic-metal heating layer 512, and non-magnetic-metal heating layer 513, and an exciting coil 531, which will be described below, is disposed inside the fixing member, near the place where the fixing and pressure members make contact with each other.

The electromagnetic induction section 530 is composed of an exciting coil 531, a ferrite core 532, and a support member 533. The exciting coil 531 is formed by winding a litz wire, composed of 300 twisted enamel wires each 0.1 mm across, in the direction along the axis of the fixing roller 511. Inside the exciting coil 531 so wound is disposed the ferrite core 532 for intensifying the magnetic field. The support member 533 is formed of heat-resistant synthetic resin, and is provided with a ferrite core housing portion 533*a* and a curved portion 533*b* formed to fit the curvature of the fixing roller 511. The exciting coil 531 is so wound as to surround the ferrite core housing portion 533*a* and run along the curved portion 533*b*.

The litz wires, of which the exciting coil 531 is formed, may be so wound as to run along the circumference of the fixing roller 511. The ferrite core 532 may be replaced with a member formed of any other material than ferrite, provided that it has high magnetic permeability The electromagnetic induction section 530 is disposed inside the fixing roller 511 with the exciting coil 531 located near the place where the fixing roller 511 and the 521 make contact with each other so that a magnetic flux passes through that place.

Outside the fixing roller 511, near the exciting coil 531, there is disposed a thermistor 515. This thermistor 515 measures the temperature of the heating portion so that the temperature is controlled by controlling the output of the high-frequency electric power source.

Figure 24:
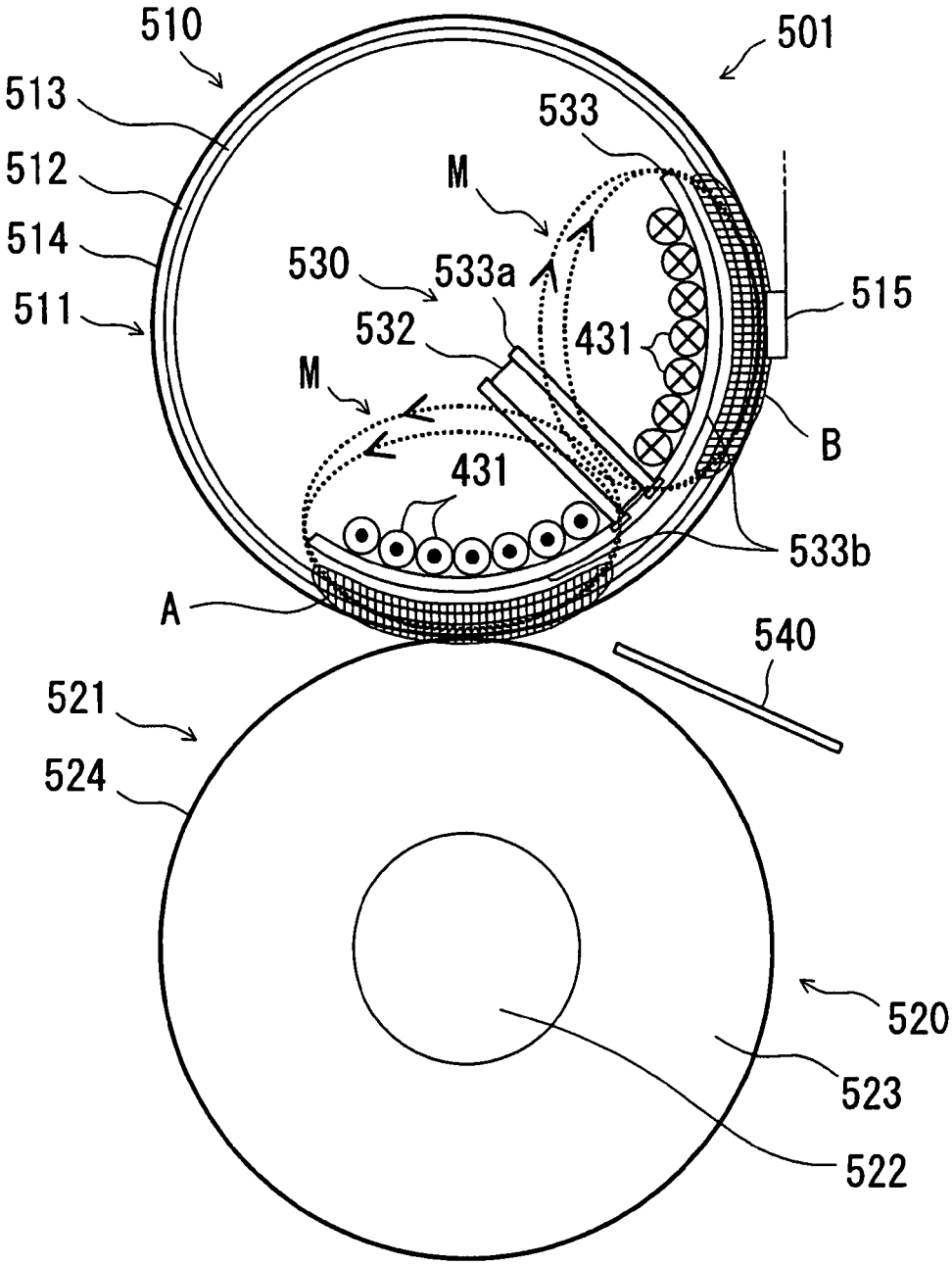
FIG. 24 is a schematic sectional view showing how the fixing apparatus of the eleventh embodiment achieves heating.

FIG. 24 is a schematic sectional view showing how the fixing apparatus of the eleventh embodiment achieves heating. The fixing apparatus 501 achieves heating in the following manner.

When a high-frequency electric current is passed through the exciting coil 531, a magnetic field is produced. Most of the magnetic flux M of the produced magnetic field passes through the ferrite core 532, which is a high magnetic permeability member, with the result that the magnetic field is intensified. When the produced magnetic flux M passes through the magnetic-metal and non-magnetic-metal heating layers 512 and 513 of the fixing roller 511, eddy currents flow in portions A and B of the metals where the magnetic flux M passes, and the electric resistance of the metals produces Joule's heat there.

In this way, the magnetic-metal and non-magnetic-metal heating layers 512 and 513 of the fixing roller 511 are made to generate heat simultaneously by the shared exciting coil 531. This makes it possible to obtain high heating efficiency. Moreover, the magnetic-metal heating layer 512 is disposed outside the non-magnetic-metal heating layer 513 with respect to the exciting coil 531 disposed inside the fixing roller 511. This makes it possible to prevent leakage of a magnetic flux to outside the fixing apparatus 501 and thereby prevent metal parts located around the fixing apparatus 501 from being heated unnecessarily.

Now, the influence of the thickness of the non-magnetic-metal heating layer 513 the fixing roller 511 on the amount of heat generated will be examined with reference again to FIGS. 12, 13, 14, and 16, which were referred to in connection with the sixth embodiment.

In a case where, in the fixing roller 511, the non-magnetic-metal heating layer 513 is formed of copper and the magnetic-metal heating layer 512 is formed of non-magnetic stainless steel SUS430, as concluded in the similar examination made in connection with the sixth embodiment, when the copper layer is 7.0 μm or less thick, the total amount heat generated is larger than 1.0. In particular, in the range where the thickness of the copper is from 2.0 μm to 6.0 μm, the total amount of heat generated is close to its peak value. That is, it is possible to obtain higher heating efficiency when the fixing roller 511 is formed with a non-magnetic metal and a magnetic metal combined together than when is formed with a magnetic metal alone. By giving the copper a thickness in this range, it is possible to obtain 10% higher heating efficiency.

Next, a case where the non-magnetic-metal heating layer 513 of the fixing roller 511 is formed of non-magnetic stainless steel SUS304 will be examined with reference to FIG. 13. Here, the magnetic-metal heating layer 512 is assumed to be formed of magnetic stainless steel SUS430. FIG. 13 shows that, when the layer of non-magnetic stainless steel SUS304 is 300 μm or less thick, the total amount of heat generated is larger than 1.0. In particular, in the range where the thickness of the non-magnetic stainless steel SUS304 is from 90 μm to 257 μm, the total amount of heat generated is close to its peak value. That is, as examined in connection with copper above, it is possible to obtain 10% higher heating efficiency than when the fixing roller 511 is formed with a magnetic metal alone. In view of this, in the fixing apparatus 501 of the eleventh embodiment, the non-magnetic stainless steel SUS304 of which the non-magnetic-metal heating layer 513 of the fixing roller 511 is formed is given a thickness of 250 μm.

FIG. 14 shows that, as in the sixth embodiment, the conditions under which the total amount of heat generated is larger than 1.0 are fulfilled when the eddy current load of the non-magnetic-metal heating 5 is $2.4\times10^{-3}\Omega$ or more, in particular in the range from $2.8\times10^{-3}\Omega$ to $8.0\times10^{-3}\Omega$. With the eddy current load of the non-magnetic-metal heating layer 513 within this range, it is possible to obtain high heating efficiency even with a metal other than copper or non-magnetic stainless steel SUS304.

In a case where aluminum is used as the non-magnetic metal, since aluminum has an electrical resistivity of $2.66\times10^{-3}\ \Omega\cdot m$, by dividing this by the values of the eddy current load given above, it is found that a layer thickness of 11.0 μm or less yields high heating efficiency. A more preferred range is from 3.3 μm to 9.5 μm.

It is to be understood that the present invention may be carried out in any other manner than specifically described as embodiments above, and many modifications and variations are possible within the scope of the concepts of the present invention.

What is claimed is:

1. A fixing apparatus comprising:

a first heating member that is provided with a first heating layer formed of a non-magnetic metal;

a second heating member that is provided with a second heating layer formed of a magnetic metal; and an exciting coil that is disposed inside the first heating member, wherein the first and the second heating members make contact with each other to form in between a nip portion through which a medium on which fixing is performed is passed, and the exciting coil is disposed near the nip portion so as to make the first heating layer and the second heating layer generate heat in a first heating section near the nip portion when the exciting coil is energized.

2. The fixing apparatus as claimed in claim 1, wherein the first and the second heating members move rotationally respectively in a direction in which the medium is conveyed in the nip portion, and the exciting coil is so structured to make the first heating layer generate heat in a second heating section which is upstream of the nip portion with respect to a direction in which the first heating member moves rotationally.

3. The fixing apparatus as claimed in claim 2, wherein a high magnetic permeability member is disposed near the exciting coil, and the exciting coil is wound around the high magnetic permeability member.

4. The fixing apparatus as claimed in claim 3, wherein the high magnetic permeability member is ferrite.

5. The fixing apparatus as claimed in claim 3, wherein the exciting coil is so disposed as to make one flow of magnetic flux from the exciting coil pass through the high magnetic permeability member and the first heating section and other flow of magnetic flux from the exciting coil pass through the high magnetic permeability member and the second heating section.

6. The fixing apparatus as claimed in claim 1, wherein an eddy current load of the first heating layer is in a range from $2.8\times10^{-3}$ Ω to $8.0\times10^{-3}$ Ω.

7. The fixing apparatus as claimed in claim 1, wherein the first heating layer is formed of copper, and a thickness of a layer of the copper is in a range from 2.0 μm to 6.0 μm.

8. The fixing apparatus as claimed in claim 1, wherein the first heating layer is formed of aluminum, and a thickness of a layer of the aluminum is in a range from 3.3 μm to 9.5 μm.

9. The fixing apparatus as claimed in claim 1, wherein the first heating layer is formed of non-magnetic stainless steel, and a thickness of a layer of the non-magnetic stainless steel is in a range from 90 μm to 257 μm.

10. The fixing apparatus as claimed in claim 1, wherein an eddy current load of the second heating layer is in a range from $3.0\times10^{-4}$ Ω to $2.0\times10^{-2}$ Ω.

11. The fixing apparatus as claimed in claim 1, wherein the second heating layer is formed of nickel, and a thickness of a layer of the nickel is in a range from 3.5 μm to 100 μm.

12. The fixing apparatus as claimed in claim 1, wherein the second heating layer is formed of iron, and a thickness of a layer of the iron is in a range from 5.0 μm to 100 μm.

13. The fixing apparatus as claimed in claim 1, wherein the second heating layer has a thickness greater than a magnetic filed permeation depth.

14. The fixing apparatus as claimed in claim 1, wherein a heat insulating layer is provided inside the second heating layer.

15. The fixing apparatus as claimed in claim 1, wherein the first heating member is a fixing member for fixing unfixed toner on the medium on which fixing is performed, and the second heating member is a pressure member for making contact with the fixing member to form in between the nip potion.

16. The fixing apparatus as claimed in claim 15, wherein one of the fixing member and the pressure member is a roller and other of the fixing member and the pressure member is a belt.

17. The fixing apparatus as claimed in claim 15, wherein both of the fixing member and the pressure member are rollers.

18. The fixing apparatus as claimed in claim 1, wherein the second heating member is a fixing member for fixing unfixed toner on the medium on which fixing is performed, and the first heating member is a pressure member for making contact with the fixing member to form in between the nip portion.

19. The fixing apparatus as claimed in claim 18, wherein one of the fixing member and the pressure member is a roller and other of the fixing member and the pressure member is a belt.

20. The fixing apparatus as claimed in claim 18, wherein both of the fixing member and the pressure member are belts.

* * * * *